US007748892B2

(12) United States Patent
McCoy

(10) Patent No.: US 7,748,892 B2
(45) Date of Patent: Jul. 6, 2010

(54) METHOD AND APPARATUS FOR COMPOUNDING MEDICATIONS

(76) Inventor: William McCoy, 206 Surrey Rd., Charlottesville, VA (US) 22901

( * ) Notice: Subject to any disclaimer, the term of this patent is extended or adjusted under 35 U.S.C. 154(b) by 710 days.

(21) Appl. No.: 11/142,156

(22) Filed: Jun. 1, 2005

(65) Prior Publication Data

US 2005/0270897 A1 Dec. 8, 2005

Related U.S. Application Data

(60) Provisional application No. 60/576,351, filed on Jun. 2, 2004.

(51) Int. Cl.
*B01F 5/06* (2006.01)

(52) U.S. Cl. ..... 366/176.3; 141/270

(58) Field of Classification Search ..... 366/176.3, 366/176.4, 181.8, 268; 141/18, 250, 270
See application file for complete search history.

(56) References Cited

U.S. PATENT DOCUMENTS 1,531,698 A * 3/1925 Janes ..... 417/437
2,477,598 A * 8/1949 Hain ..... 366/334
3,035,820 A * 5/1962 Todd et al. ..... 366/268
3,071,351 A * 1/1963 Brown et al. ..... 366/268
4,316,558 A * 2/1982 Kubiak ..... 222/181.2
4,743,229 A * 5/1988 Chu ..... 604/82
5,957,166 A * 9/1999 Safabash ..... 141/26
2002/0101785 A1* 8/2002 Edwards et al. ..... 366/268
2002/0117232 A1* 8/2002 Gisper-Sauch et al. ..... 141/2
2005/0052946 A1* 3/2005 Argentine ..... 366/176.3
2005/0213427 A1* 9/2005 Steckle et al. ..... 366/268

* cited by examiner

*Primary Examiner*—David L Sorkin
(74) *Attorney, Agent, or Firm*—Sheldon H. Parker

(57) ABSTRACT

An active ingredient, such as particles of a pharmaceutical agent, is uniformly distributed within a transdermal vehicle, such as a gel or other viscous material. The method comprises filling said first container with a non-uniform mixture of a transdermal vehicle and said active ingredient, mounting the first container on a support member, and securing a second container to the first container. The first container has a restricted opening at its proximal end and a piston mounted movably within the first container for movement between a first position proximate said first container distal end to a position proximate said first container proximal end. The second container has a restricted opening at its proximal end and a piston mounted movably within the first container for movement from a first position proximate the second container distal end to a position proximate said second container proximal end. The first container restricted opening and said second container restricted openings are in open communication. The first container's piston is moved from its position proximate the distal end to a position proximate the proximal end and thereby forcing said mixture from the first container into said second container. The positions of the first and second container relative to said support member, are reversed and the process is repeated moving the mixture back and forth between the two containers until a uniform mixture is achieved.

13 Claims, 11 Drawing Sheets

Figure 3
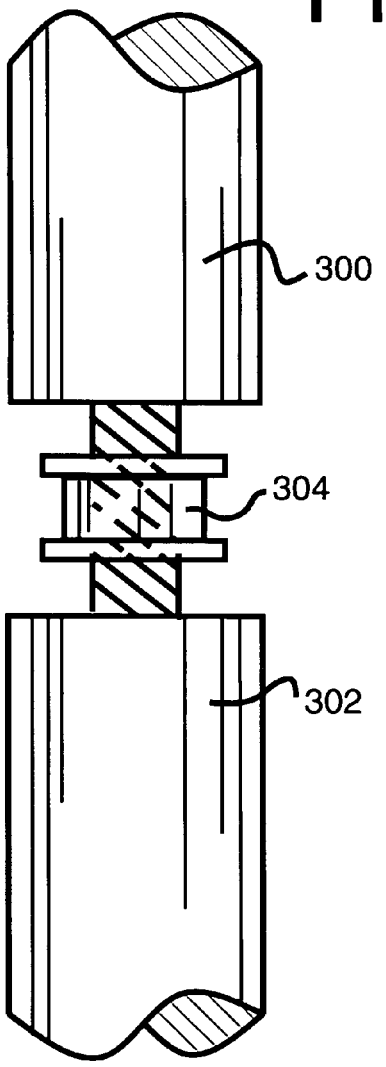
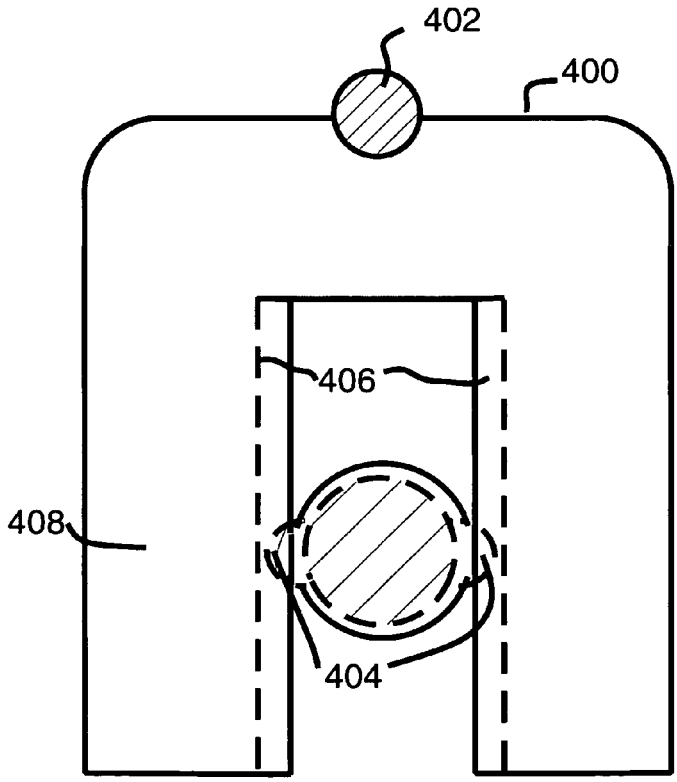
Figure 4

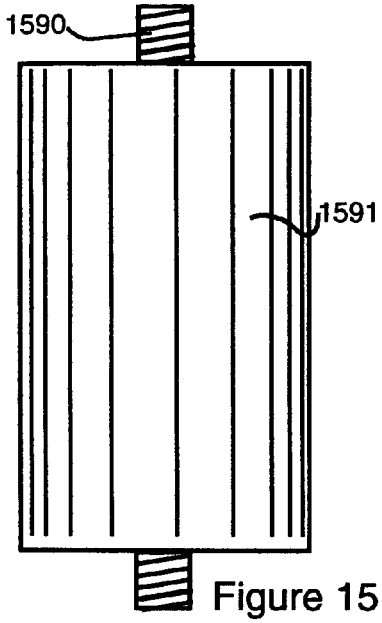
Figure 15
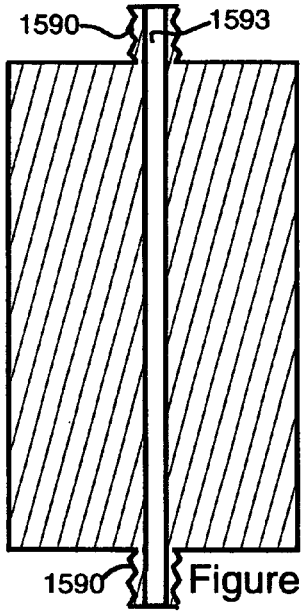
Figure 16
Figure 17
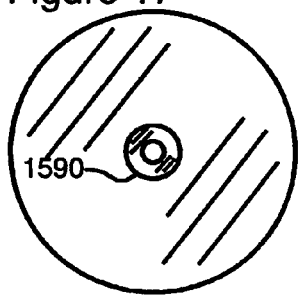
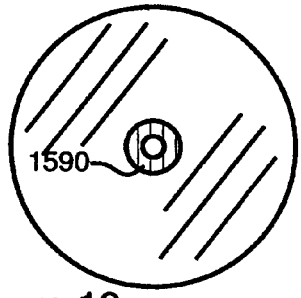
Figure 18
Figure 19
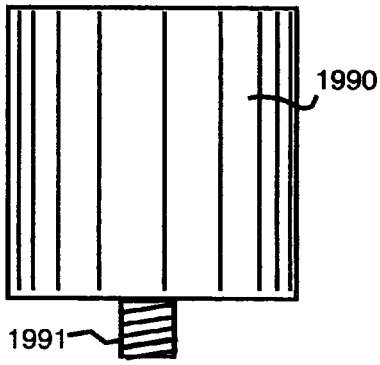
Figure 20
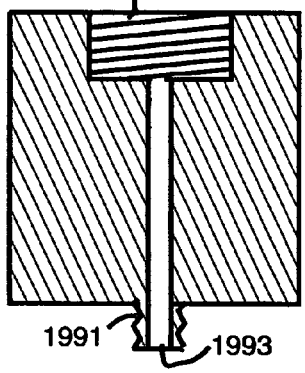
Figure 21
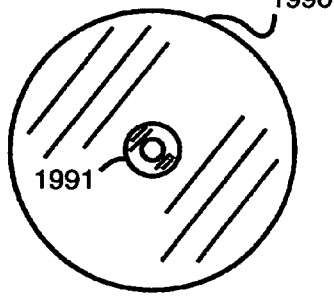
Figure 22
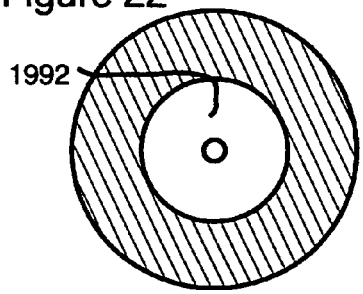

Figure 31
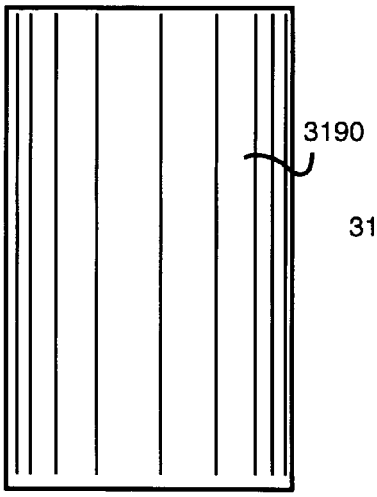
Figure 32
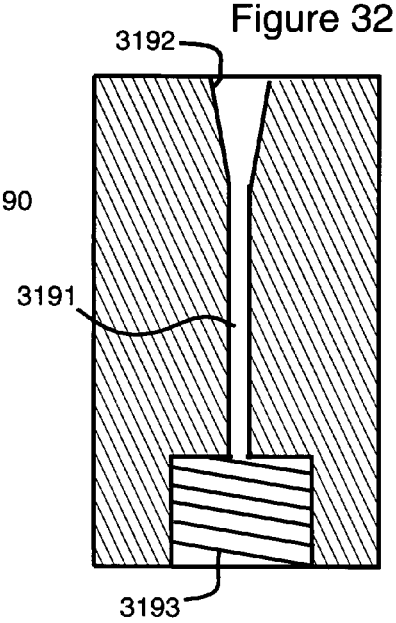
Figure 33
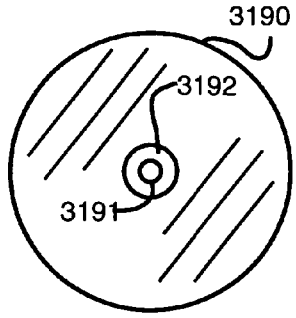
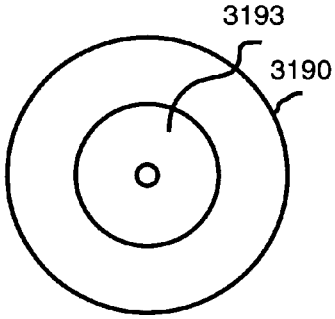
Figure 34
Figure 35
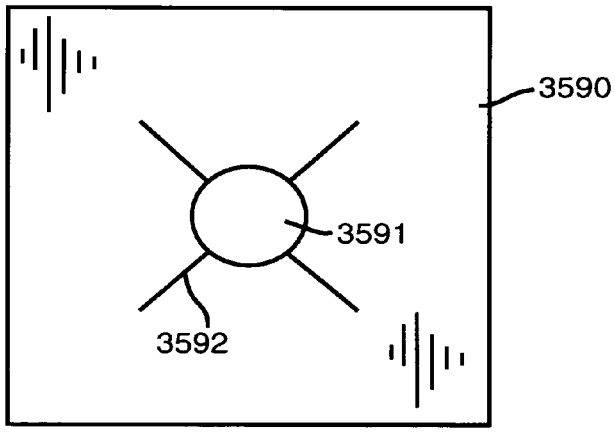
Figure 36
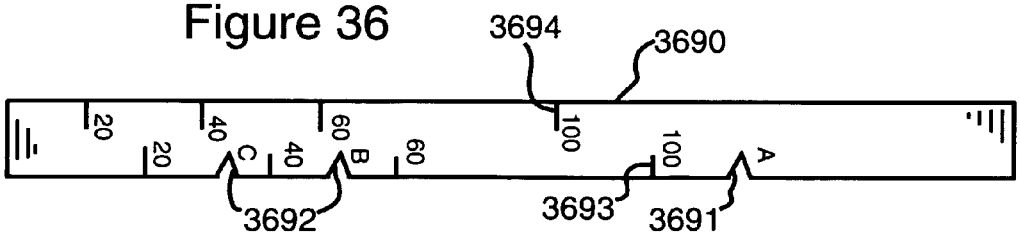

METHOD AND APPARATUS FOR COMPOUNDING MEDICATIONS

CROSS-REFERENCE TO RELATED APPLICATIONS

This application claims the benefit of provisional patent application Ser. No. 60/576,351 filed Jun. 2, 2004, the disclosure of which is incorporated herein by reference as though recited in full.

GOVERNMENT INTEREST STATEMENT

None

BACKGROUND

1. Field of the Invention

The present invention relates generally to the compounding of medications, and more particularly, to the preparation of mixtures of a viscous carrier and the active pharmaceutical agents, and to the preparation of unit doses delivery systems from compounded formulations of a viscous carrier and active pharmaceutical agents.

2. Related Art

The need for pharmacists to be able to perform in-house compounding of pluronic lecithin organogels (herein after referred to as PLO gels) is progressively increasing, due to the improvement of transdermal carriers and the lack of availability of pre-compounded formulations.

A problem encountered by a pharmacist compounding the formulation is the inability to readily blend the active ingredients and the PLO gel. A simple blending operation is inadequate to achieve the required uniform distribution of active ingredients in the PLO gel. This fundamental problem extends to the blending of active ingredients in other carriers, to produce compounded ointments, salves, balms, creams, gel, liniments, emulsions, colloids, and the like.

A related or similar problem exists in the transferring of viscous carriers from mixing containers to unit dose syringes, or similar dispenser. There is a critical need for the caregiver or patient to be able to measure the exact dose.

SUMMARY

In a first embodiment the invention relates to a method of substantially uniformly distributing an active ingredient within a transdermal vehicle. The transdermal vehicle may be a viscous material such as a gel, and the active ingredient is particles, as for example, of a pharmaceutical agent. The term carrier as used herein, refers to viscous mediums used in the production of compounded ointments, salves, balms, creams, gel, liniments, emulsions, colloids, and the like. PLO gels are an example of compounded formulations. It should be understood that the references to PLO gels is by way of example, and not by way of exclusion of other viscous mediums.

The disclosure of U.S. Pat. No. 6,652,866 is incorporate by reference for its recitation of transdermal medications. It is disclosed in the patent that vehicles such as DMSO and pleurolecithin organogel (PLO or PLO gel) have been used to increase permeability of the skin. This increased permeability caused by these compounds may be an interaction of the lipophilic liquids with the lipid bilayers of the stratum corneum, leading to decrease of barrier resistance of the skin. The term transdermal vehicles is used herein to refer to any current known or future developed ingredient in a viscous form, such as a paste or gel like form, such as DMSO and PLO or their functional equivalents, that increase the permeability of the skin or otherwise carry a medication, pharmaceutical agent, herbal ingredient or ingredients, drug, or the like, through the skin of the patient receiving the medication. The active ingredient herein referred to interchangeably as a herb, drug, pharmaceutical, medicinal agent, or medication, is generally in the form of a fine powder, that is, in particulate form and must be uniformly distributed throughout the transdermal vehicle.

A first container is filled with a non-uniform mixture of the transdermal vehicle and the active ingredient, and is mounted on a support member. A second container is secured to the first container. The first container and second container's restricted openings at their proximal ends and a piston mounted movably therein for movement between a first position proximate the distal end to a position proximate the proximal end. The two containers are in fluid communication through their restricted openings. The first container piston is driven from its position proximate the distal end to a position proximate the proximal end and thereby forcing the mixture from the first container through the first container's restricted openings into the second container. The positions of the first and second container relative to the support member, are reversed, and the second container piston is driven from the position proximate the distal end to a position proximate the proximal end and thereby forcing the mixture from the second container through the second container restricted opening and the first container restricted opening, into the first container. The procedure is repeated until the active ingredient is substantially uniformly distributed within the transdermal vehicle.

In an embodiment of the invention, the first container is threadedly connected at its proximal end to the second container proximal end, as for example, by means of a Luer connector. The Luer connector can be internally threaded to accept external threads of the two containers' proximal ends or externally threaded to accept internal threads of the two containers' proximal ends.

In another embodiment of the invention, a driving member is fixed in relation to the support member, and the first container and the second container are rotatably secured to an arm member secured to the support member. The positions of the first and second container relative to the support member, are rotated substantially 180 degrees such that the first container piston is in direct contact with the driving member when the first and the second container are in a first rotated position and the second container piston is in direct contact with the driving member when the first and the second container are in a second rotated position.

In another embodiment of the invention, the first container piston is releasably secured to the driving member when the first and the second container are in a first rotated position and the second container piston is releasably secured to the driving member when the first and the second container are in a second rotated position.

In an embodiment of the invention at least one of the first container and second container is a syringe, and preferably, both containers are syringes.

In an embodiment of the invention, active ingredient that has been substantially uniformly distributed within the transdermal vehicle is transferred from a supply container to a plurality of measured dose containers, preferably single dose containers, such as syringes.

In an embodiment of the invention, a transdermal vehicle having an active ingredient substantially uniformly distributed therein is transferred from a supply container to a plurality of dose containers. The transdermal vehicle in this embodiment is a viscous material and the active ingredient is in particulate form. The transfer is achieved by mounting the supply container on a support member, securing a dose container to the supply container, which has a restricted opening at its proximal end and a piston mounted movably within the supply container for movement between a first position proximate the supply container distal end to a position proximate the supply container proximal end. The dose container has a restricted opening at its proximal end, and the dose container restricted opening and the supply container restricted opening are in open fluid communication. The supply container piston is driven from the position proximate the distal end to first position toward the proximal end thereby forcing a portion of the mixture from the supply container through the supply container restricted opening and the dose container restricted opening, into the dose container, until the dose container is substantially filled. The dose container is separated from the supply container, and a second dose container is secured to the supply container. Each dose container has a restricted opening at its proximal end. As before, the supply container is connected to the dose container in a manner such that the dose container restricted opening and the supply container restricted opening are in open communication. The supply container piston is driven from the first position toward the proximal end to a second position thereby forcing a second portion of the mixture from the supply container through the supply container restricted opening and the second dose container restricted opening, into the second dose container, until the second dose container is substantially filled. The process is repeated a plurality of times, thereby filling at least third and fourth dose containers. The number of dose units that are filled is dependant only upon the quantity of compounded formulation in the supply container. The quantity of compounded formulation can correspond to a single patient's requirement for the medication for a predetermined period of time, or can correspond to the requirements of a plurality of patients. Preferably the procedure is repeated until the supply container is substantially empty. Preferably the dose containers are in the form of single dose syringe, but can be multiple dose units, to provide, as for example, delivery of one days' morning and evening doses. Where the delivery of an exact dose is critical, single dose units can be provided.

In another embodiment of the invention, the dose containers are in the form of open ended tubes. The tubes are filled through the threaded proximal end and the open distal end of each tube is sealed after each tube is filled. Preferably, the open end of each tube is sealed by clamping the open end and fusing the fusible tube at the clamped end. Alternatively, the tube can be a metal such as aluminum, or a plastic, and can be sealed by mechanical means, such as folding and crimping or otherwise sealed as well known in the art.

In an embodiment of the invention, the dose tube is a fusible polymeric material and the open is sealed by thermal or sonic welding.

In an embodiment of the invention, the device for substantially uniformly distributing an active ingredient within a transdermal vehicle comprises a first container and a second container. The first container contains a non-uniform mixture of a transdermal vehicle and the active ingredient, and has a restricted opening at its proximal end and a piston mounted movably within the first container for movement between a first position proximate the first container distal end to a position proximate the first container proximal end. The first container is mounted on the support member, and the second container is secured to the first container, preferably by a threaded connector, such as a Luer connector. The second container having a restricted opening at its proximal end and a piston mounted movably within the first container for movement from a first position proximate the second container distal end to a position proximate the second container proximal end, the first container restricted opening and the second container restricted opening are in open communication. The first container piston is moved from the position proximate the distal end to a position proximate the proximal end whereby the mixture is forced from the first container through the first container restricted opening and the second container restricted opening, into the second container. The position of the first and second container are reversible relative to the support member, whereby moving the second container piston from the position proximate the distal end to a position proximate the proximal end forces the mixture from the second container through the second container restricted opening and the first container restricted opening, into the first container. The movement of the pistons is by a drive means that is mounted in a fixed position relative to the support member. The drive has a drive means piston positioned to contact the first container piston when the first container piston is in a first location proximate the drive means, and the second container piston when the position of the first container and the second container are reversed relative to the support member, and the second container piston is in the first location and the first container piston is in a second location.

In an embodiment of the invention, the drive means piston is selectively moved from the first container piston from the position that is proximate the distal end, to a position proximate the proximal end of the second container piston. The second container piston is then driven by the drive means piston from the position proximate the second container's distal end to a position proximate the second container proximal end. Preferably, a system of a lever and gears is employed to drive the drive means piston.

In an embodiment of the invention the first container proximal end is threadedly connected to the second container proximal end by an internally threaded Luer.

In an embodiment of the invention, the first container and the second container are secured to an arm member. The first container and the second container are rotatable relative to the support member, preferably substantially 180 degrees, such that the first container piston is in direct contact with the drive means piston when the first and the second container are in a first rotated position and the second container piston is in direct contact with the drive means piston when the first and the second container are in a second rotated position. Preferably, one or both of the containers are syringes.

In accordance with an embodiment of the invention, a device is provided for use in transferring a transdermal vehicle having an active ingredient substantially uniformly distributed therein, from a supply container to a plurality of dose containers. The supply container is filled with a substantially uniform mixture of a transdermal vehicle and the active ingredient, and the first container is mounted on a support member. A dose container is threadedly secured to the supply container. The supply container having a restricted opening at its proximal end and a piston mounted movably within the supply container for movement between a first position proximate the supply container distal end to a position proximate the supply container proximal end. The dose container has a restricted opening at its proximal end, and the dose container restricted opening and the supply container restricted opening are in open communication. Drive means is mounted in a fixed position and has a drive means piston positioned to contact the supply container piston. The drive means piston is driven to selectively incrementally move the first container piston from the position proximate the distal end toward a position proximate the supply container proximal end. Preferably, the drive means piston is driven by a manually actuated lever and gears. Preferably, the dose containers are single dose syringes. Alternatively, the dose containers can be open ended tubes, having sealable open ends. The open end of each tube can be sealed by clamping the open end and fusing the tube at the clamped end. Preferably, the dose tube is a fusible polymeric material and the open end is sealed by thermal or sonic welding.

In an embodiment of the invention the supply container is threadedly connected to the dose container by a Luer connector. Preferably, the Luer connector second end is internally threaded to receive external threads of the dose container.

BRIEF DESCRIPTION OF THE DRAWINGS

FIG. 3 is a schematic fragmentary illustration, showing the connected ends of the mixing vessels of FIG. 1.

FIG. 4 is a top view of an alternate mechanism for supporting a syringe in a fixed position relative to the mixing device.

FIG. 15 is a side view of a Luer connector.

FIG. 16 is a cross-sectional view of the Luer connector of FIG. 15.

FIG. 17 is a top view of the Luer connector of FIG. 15.

FIG. 18 is a bottom view of the Luer connector of FIG. 15.

FIG. 19 is a side view of another embodiment of a Luer connector.

FIG. 20 is a cross-sectional view of the Luer connector of FIG. 19.

FIG. 21 is a bottom view of the Luer connector of FIG. 19.

FIG. 22 is a top view, in cross-section of the Luer connector of FIG. 19.

FIG. 31 is a side view of another embodiment of a Luer connector.

FIG. 32 is a cross-sectional view of the Luer connector of FIG. 31.

FIG. 33 is a top view of the Luer connector of FIG. 31.

FIG. 34 is a bottom view of the Luer connector of FIG. 31.

FIG. 35 is a plan view of a film or sheet material that is used to label jars or bottles.

FIG. 36 is a plan view of a volume measuring stick.

DETAILED DESCRIPTION OF EMBODIMENTS OF THE INVENTION

DESCRIPTION OF THE INVENTION

Figures 1, 2:
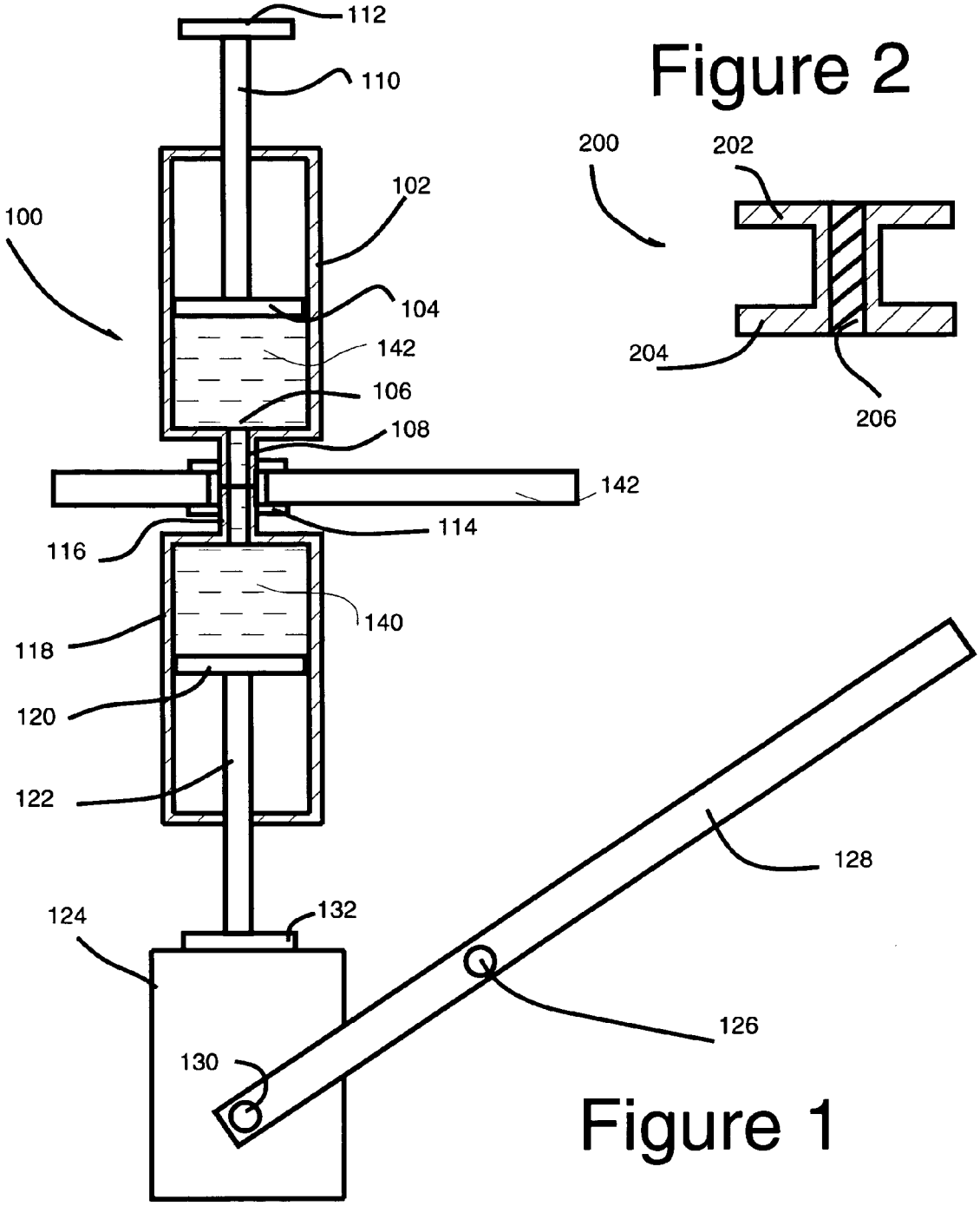
FIG. 1 is a schematic illustration of a mixing device for use in accordance with the present invention.
FIG. 2 is a cross-sectional representation of a connector, for use in connecting two mixing vessels, of the syringe type.
Figure 5:
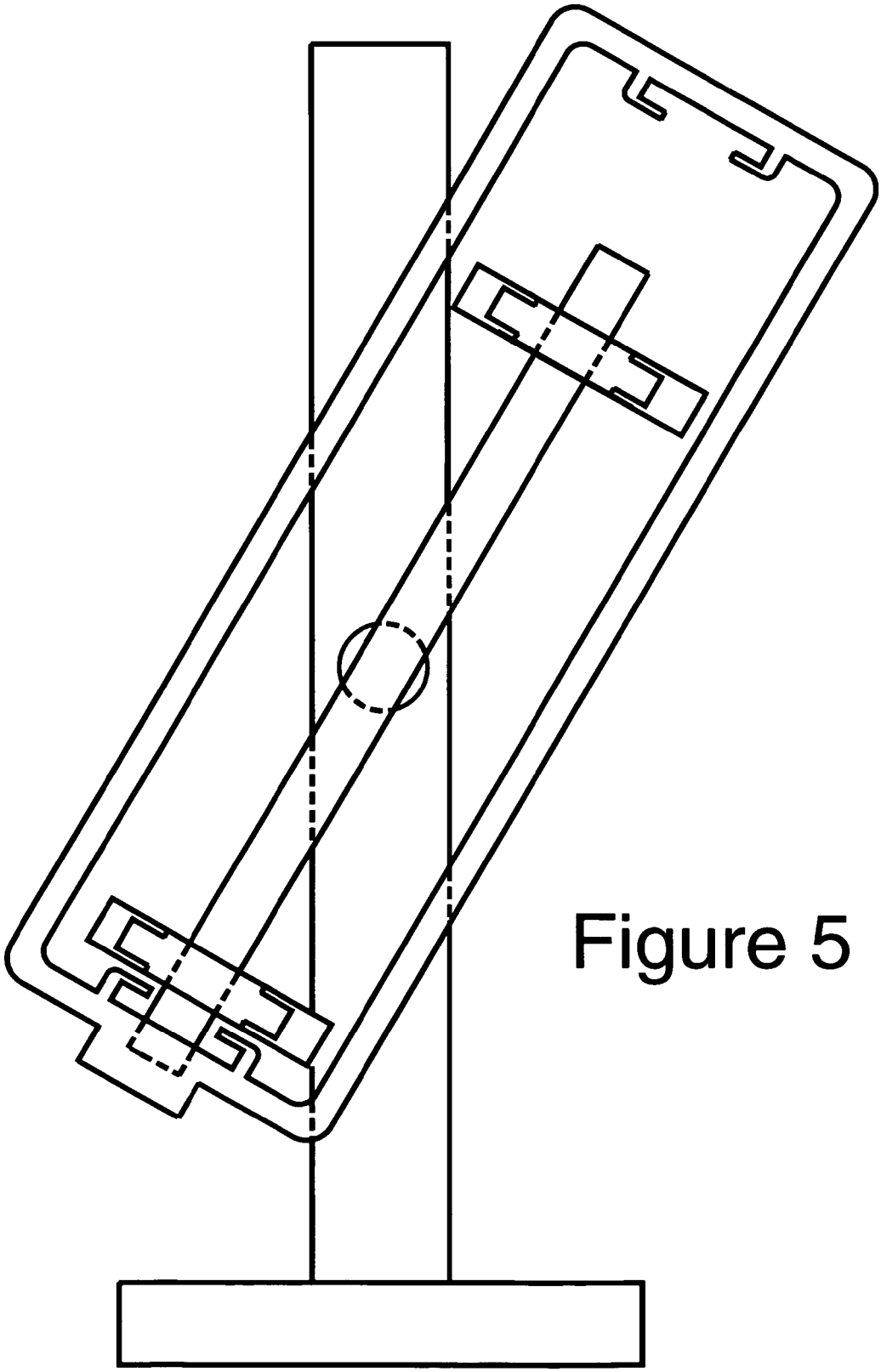
FIG. 5 is a schematic illustration of the rotation of the syringe support member of FIG. 7.

It has now been found that blending can be carried out by forcing a crudely blended material from a first container to a second container. The blending can be achieved by passing the initial blend through a small connecting orifice between the two containers. The forcing of the material from a relatively large diameter container through a relatively small diameter channel and into a relatively large diameter second container produces a turbulent flow. That is, the transition from large diameter to small diameter to large diameter produces a fluid motion having local velocities and pressures that fluctuate randomly. The fluid is violently agitated or disturbed, thus producing an extremely efficient mixing system.

Nevertheless, it is necessary to repeat the process as many as fifteen times, to have an assurance of achieving the required distribution of the active ingredient in the carrier medium. It is preferred that the number of repetitions exceeds five in number and more preferably exceeds ten. A complete cycle, that is, the transfer from the first container to the second container, and then back to the first container, is defined as two repetitions.

The viscosity of the material being blended is generally so high as to make it very difficult to force the material through the narrow orifice or channel between the containers. The containers are fitted with a movable wall opposite the narrow orifice end that is moved in a piston like action. Advantageously, the container can be in the form of a syringe. However, it has been found that it takes a great deal of physical energy to drive the piston and force the gel through the connecting channel. Insufficient blending may produce an insufficient level of blending. While a motorized unit can supply the required driving force, such units are expensive and may not be suited for use by many pharmacists.

It has been found that a lever mechanism can be used to facilitate the material transfer without the need for the user to be significantly strained by the manual operation. The mechanical advantage of the lever action or similar structure makes it unnecessary to resort to the use of a motorized device. The result is a simple structure that is low in cost and easy to use and maintain, and can be used to compound formulations, such as PLO gels, in remote areas or undeveloped areas where electricity is unavailable or unreliable. Additionally, the system of the present invention operates independently of the voltage provided since it is a manual system. Accordingly, the same system can be used universally, irrespective of the voltage variations between countries or continents.

The paired containers can be interconnected by a Luer-Luer connector, as well know in the art. While reference will generally be made to the containers as syringes, it should be understood that other container structures can be used. The critical features of a container are a plunger, a restricted orifice, and an outlet port that can be removably secured to a mated, corresponding structural design container. Generally, the containers are of the same size but in one embodiment, one container is a "master" container and the other is a smaller, satellite container. An example of this embodiment is seen where a master container holds at least a month's supply of compounded material and the satellite container is filled with a single dose of compounded material. In this embodiment, it is preferred that the lever mechanism is designed to transfer a single dose of compounded material to a single dose syringe. Advantageously, the lever is designed to be moved either an incremental amount corresponding to a predetermined dose size or, in another embodiment, is moved through a full arc while the piston is moved by a preset amount. In this latter embodiment, a ratchet system can optionally be used to move the piston by the preset incremental distance for each full swing of the lever. This embodiment provides the user with the full mechanical advantage of the lever and is suitable for use both with the mixing system and the single dose transfer system.

FIG. 1 shows a mixing device using a lever actuated press device of the type used for loading gun powder in gun shells, as well known in the art. Examples of known ammunition presses are the Square Deal B and other presses from Dillon Precision Products, Inc., 8009 E. Dillon's Way, Scottsdale, Ariz. 85260. 480-9488009, #13028 Spot Manuals SOB Manual Folder, SOB Manual V4.5 9/01 WJC. the disclosure of which is incorporated by reference, as though recited in full. Also incorporated by reference as though recited in full, are the presses disclosed by Redding Reloading Equipment, 1089 Starr Road, Cortland, N.Y. 13045, in the Redding Reloading Equipment Catalog Copyright 2004.reddingreloading.com/pages/presses. The feature required in accordance with the present invention is a cylinder or shaft that moves in response to a linkage mechanism that provides a mechanical advantage. Preferably, the linkage is manually activated and preferably, the shaft moves along a vertical path. The shaft functions as a piston. Preferably, a lever arm is provided for the manual application of a mechanically multiplied force to the piston. Linkage and lever mechanisms of the ammunition reloading type are disclosed in U.S. Pat. Nos. 4,526,084, 4,331,063, 2,031,850, 3,771,411, 4,163,410, the disclosures of which are incorporated here by reference as though recited in full.

Drill press types of mechanisms are disclosed in U.S. Pat. Nos. 4,163,410, 5,634,748 and 6,692,201, the disclosures of which are incorporated here by reference as though recited in full.

Preferably, the lever arm mechanism is positioned to move from a position, roughly 10 to 30 degrees from a horizontal to a position that is 70 to 100 degrees from the horizontal. An arc of movement of about 45 to 90 is preferred. It is noted that it is usually easier for a person to push a lever through a downward arc than to pull a lever through an upward arc. Accordingly, the design is preferably such that the lever is pulled from a position near the horizontal and is rotated toward a vertical orientation. Conversely, the lever is pushed from the near vertical position toward a horizontal orientation.

Additionally, incorporated by reference as though recited in full, is the Boss Reloading Press, disclosed By The Reloading Bench at website—www.reloadingbench.com ; the Ponsness/Warren Metallic II, Ponsness/Warren 768 Ohio Street, Rathburn, Id. 83858 and Reloading Presses from Huntington, P.O. Box 991, 601 Oro Dam Blvd., Oroville, Calif., 95965, such as the RCBA Pro 2000 and the RCBA Ammomaster Press, www.huntingtons.com/Presses.html. The lever link mechanisms are well illustrated in the above referenced reloading presses.

As illustrated in FIG. 1, the presses have a vertically moving platen or cylinder 124. Movement of the lever 128 downward rotates the lever arm mechanism about a pivot 126. The lever arm is connected by a connector 130 to the cylinder 124 which is moved upwardly as the lever arm is pulled downwardly. The particular design of the lever mechanism is not narrowly critical and can be of any of the common ammunition reloader press designs noted above, as well as equivalent structures. It is only critical that the downward rotation of the lever arm 128 produce a straight line upward movement of the cylinder 124. Any design that provides a mechanical advantage can be used in order to minimize the force that must be applied to the lever arm relative to the resistance to the upward movement of the cylinder 124. It should be understood that while a motor driven mechanism can be used, the use of a manual lever mechanism is preferred for economic reasons and for convenience.

The embodiment of FIG. 1 illustrates the use of syringes as the transfer vessels. While other containers can be used, the use of syringes is preferred. The upward movement of the cylinder 124 causes the mixture 140 to be transferred from the syringe 118 to the syringe 102. The syringes are of typical configuration. The syringe or equivalent device 102 includes a narrow threaded end 108, a narrow opening 106 to the exterior threaded end or tip 108, a piston mechanism that includes a seal 104, as well known in the art, a piston shaft 110 and a piston end 112.

Luer connectors are well known in the art and are described, for example in literature from BD (Becton Dickinson and Company). 1 Becton Drive, Franklin Lakes. N.J. 07417-1886. website bd.com, the disclosure of which are incorporated herein by reference, as though recited in full.

FIG. 2 illustrates a Luer type connector 200 in which internal threads 206 are provided for threadedly connecting to the exterior threads of a syringe or equivalent device. The Luer connector as illustrated has a pair of circular flanges 202 and 204, typically provided for ease of gripping the device.

In the embodiment of FIG. 1, the Luer connector 114 is secured to a stationary support arm 142. The support arm 142 is fixed in position relative to the movable piston 130. The critical part of the relationship is that the piston or cylinder 124 moves relative to the support arm 142. In the preferred embodiment, the support arm 142 is stationary and the piston 124 moves relative to the stationary support arm. While vertical movement is preferred, other orientations can be used.

The syringe or equivalent device 118 includes a narrow threaded end 116, a narrow opening or port to the exterior threaded end or tip 116, a piston mechanism that includes a seal 120 as well known in the art, a piston shaft 122 and a piston end 132.

Figure 8:
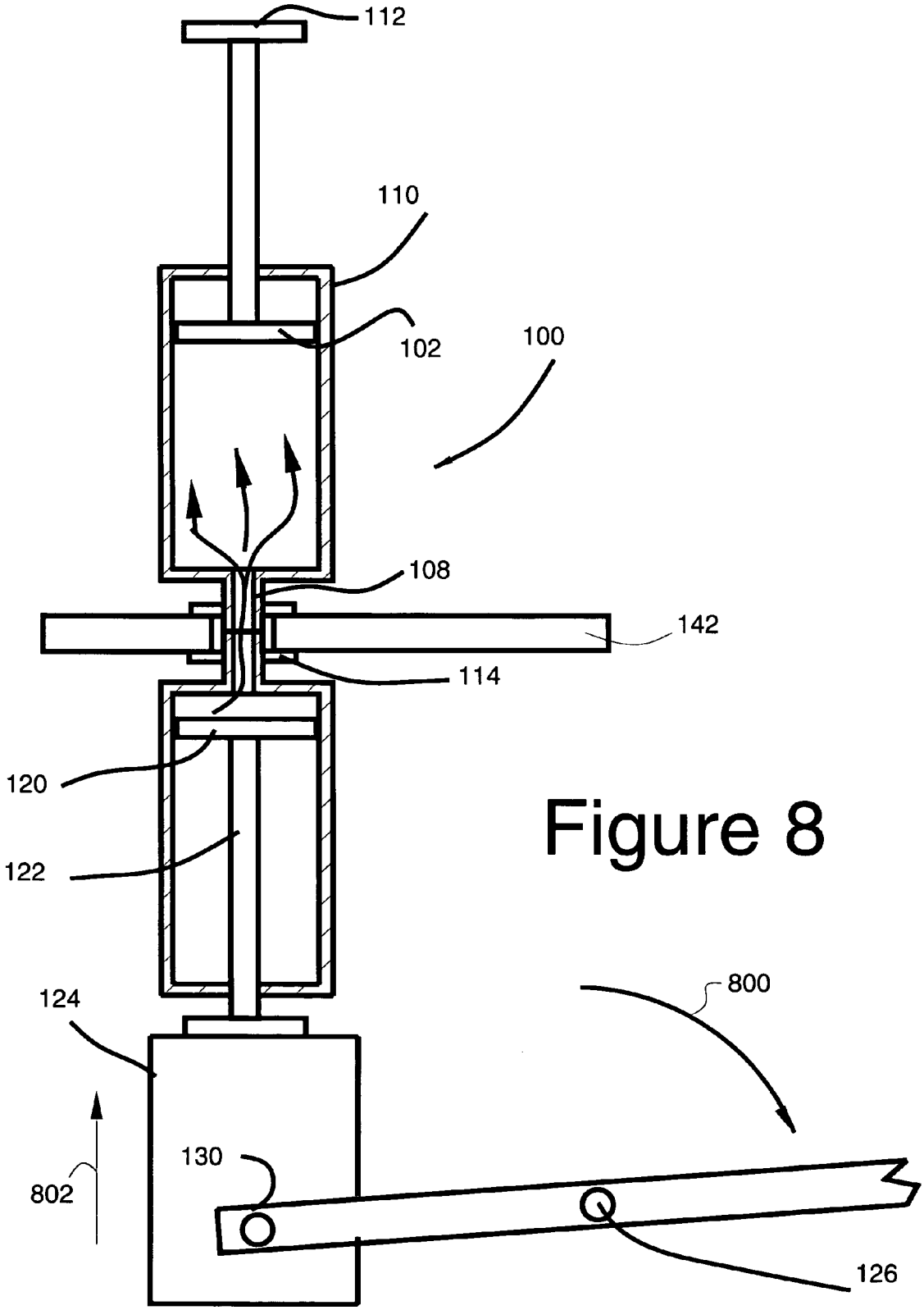
FIG. 8 is a schematic illustration of the mixing device of FIG. 1, showing additional transfer of medium from the first syringe to the second syringe.

FIG. 8 shows the lever arm rotated downwardly in the direction of arrow 800, causing the piston 124 to move upwardly as illustrated by the arrow 802. The upward movement of the piston seal 120 drives the viscous fluid mixture from the syringe 118 into the upper syringe 102. Driving the piston 122 upward, correspondingly forces the piston seal 102 to move upward. When the lever has been fully rotated, the lever is returned to its starting position and the positions of the syringes 102 and 118 are reversed. The reversal of the syringes can be accomplished by rotating the support arm 142, or alternatively, by removing the connected syringes from the support arm, inverting the syringes and returning them to their supported position in the support arm 142. Thus, syringe 102 is the lower syringe and 118 is the upper syringe. The lower syringe 102 is now filled with the mixture and the process is repeatedly until a pharmaceutically sufficient mixing has been accomplished.

FIG. 3 is an enlarged view of two syringes 300 and 302 threadedly connected by a Luer connector 304.

FIG. 4 is a schematic illustration showing a top view of an alternate embodiment of a support arm for a syringe. The support arm 400 is adjustably connected to a vertical support 402. The support arm 402 is releasably fixed to the vertical support 402 such that the arm can be moved upward or downward on the vertical support 402.

Figure 6:
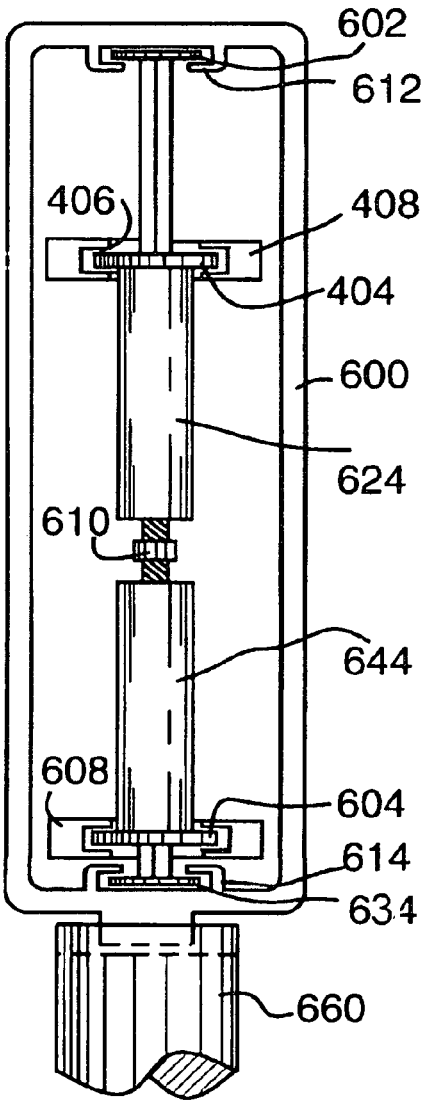
FIG. 6 is a fragmentary schematic front view illustration of another embodiment of a mixing device of the present invention.

FIG. 6 is a schematic illustration of an alternated embodiment of the invention, in which the two syringes, 624 and 644 have their pistons locked together by a frame member 600. It has been found that the viscosity of the medium that is being mixed can be too high for the piston seals 104 and 120, as illustrated in FIG. 1. By pushing on one piston and simultaneously pulling on the other, the strain on the seals is equalized and common commercial syringes can readily be used in the mixing process of the present invention. In this embodiment, the upper end 602 of the piston of syringe 624 is held within a slide fit region of a flanged member 612. Similarly, the piston end 604 of the syringe 644 is held by the flange gripping member 614. The flange gripping member 614 is dimensioned to readily receive the end 604 of the syringe 644, and a friction fit is not desirable, but rather, a sliding fit is preferred. The same relationship is provided for the piston of the syringe 624.

The frame member 600 is fixed to the vertically movable piston 660 by means of a sliding connection, as for example, a dovetail fit. Alternatively, another type of interlocking relationship can be provided, such as that which is provided between members 602 and 612. When the lever mechanism is activated, the piston 660 rises and the pistons 634 and 602 are simultaneous pushed and pulled respectively. The syringes 624 and 644 are held in place during this action by virtue of having their wings or extensions 404 and 604 secured within the support arms 408 and 608 respectively. The fit within the retaining groove 406 can provide for slight vertical movement, such that the syringes can be readily placed within the support arms or removed therefrom.

When the lever arm is fully rotated and the piston 634 is fully depressed, the two syringes can be slid away from the support arms 408 and 608. The piston is returned to its lowered position and the syringes are reinserted in the inverse position. Thus, the lower piston, which is now piston 602, can be moved upwardly by the piston 660 until it reaches its fully depressed position. In this manner, the medium within the syringes is transferred back and forth through the narrow port between the syringes, and is subjected to an effective mixing action. It is noted that the syringes can be secured together by a Luer connector 610 as described above.

Figure 7:
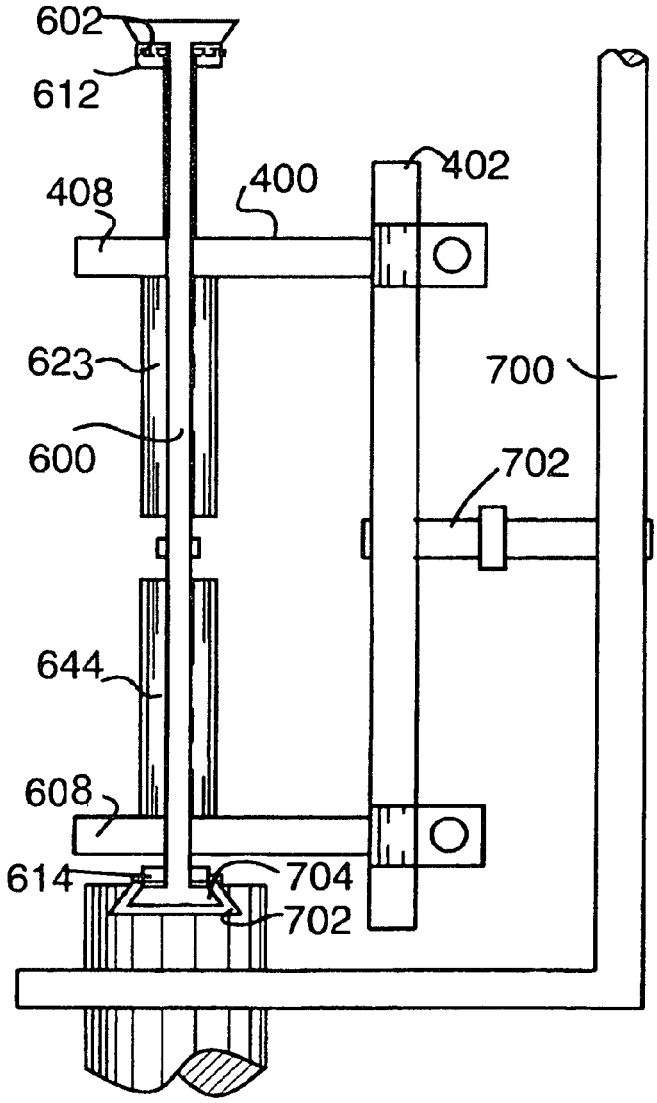
FIG. 7 is a fragmentary side view of the embodiment of FIG. 6.

In the embodiment of FIG. 7, the support arms 408 and 608 are connected to a rotatable shaft 402. The rotatable shaft 402 can be rotatably fixed to the stationary support member 700, as for example by a rotating shaft member 702. In this embodiment, the frame member 600 is rotated sufficiently to disengage the dovetails interconnection 702 and 704, the piston is lowered to its starting position and the frame is rotated such that the dovetails interconnection is restored. The lever is then, once again lowered, driving the piston 660 upwards and forcing the medium from the now lower syringe 624 into the now upper syringe 644.

In another embodiment of the invention, a stepwise filling mechanism 900 is provided. A master container, such as a large volume syringe, an open ended container, or the like, 910 contains a large quantity of the final mixture 906. The quantity can be sufficient for providing a patient with medication for an extended period, such as a week or a month, either in single dose units, or multiple daily applications. In order to facilitate accurate dose application by the patient, preferably, the mixture 906 is transferred to a plurality of single dose dispensing containers, such as syringes 902, syringe like devices, dispensing tubes, or the like. The syringe 902 is secured to the master cylinder 910 by a Luer connector or simply by threading the externally threaded syringe 902 into the internally threaded syringe 910.

The master cylinder 910 is secured to a fixed arm 904 by any convenient means, as for example, any of those described above. The master cylinder or supply container 910 can be of the type sold under the trademark UNGUATOR. The fixed arm 904 is carried by a stand post 908 that is fixed to a table, a base, or otherwise stably positioned on a table or the like. The master cylinder is connected to the unit dose member 902 by a Luer internally threaded connector 930, which can be of the same type as connector 2790 of FIGS. 27 to 30. The lever arm 928 provides a mechanical advantage and is rotated incrementally to a degree that corresponds to a single dose of medication. The piston 914 moves the container seal member 912 up by the predetermined amount, in a stepwise manner, such that a single dose of medication 906 is transferred to the syringe 902. The gradations 916 on the syringe 902 can be used to identify that the requisite quantity of medication has been transferred to the syringe. The syringe can be transparent or translucent and the piston seal within the syringe can be viewed. In this manner, the movement of the seal is used to indicate the amount of medication that has been transferred. Alternatively, the unit dose container can be a tube having an externally threaded proximal end and an open, unsealed distal. After the unit dose tube is filled, it is sealed.

In an embodiment of the invention, the transfer of medication can be in calibrated or measured quantities, in order to assure that the required quantity of medication has been transferred. Preferably a ratchet mechanism is used such that the lever's movement is restricted to a single direction and to predetermined increments, until such time as the supply container is emptied and the ratchet is reset to its starting position. A ratchet is defined as a mechanism that consists of a pawl that engages the sloping teeth of a wheel or bar, permitting motion in one direction only. The pawl, wheel, or bar of this mechanism produces a single direction rotation in fixed increments. The incremental movement corresponds to a predetermined volume of medication. Thus, a dose of medication can be equal to a single increment or a plurality of increments.

Figure 9:
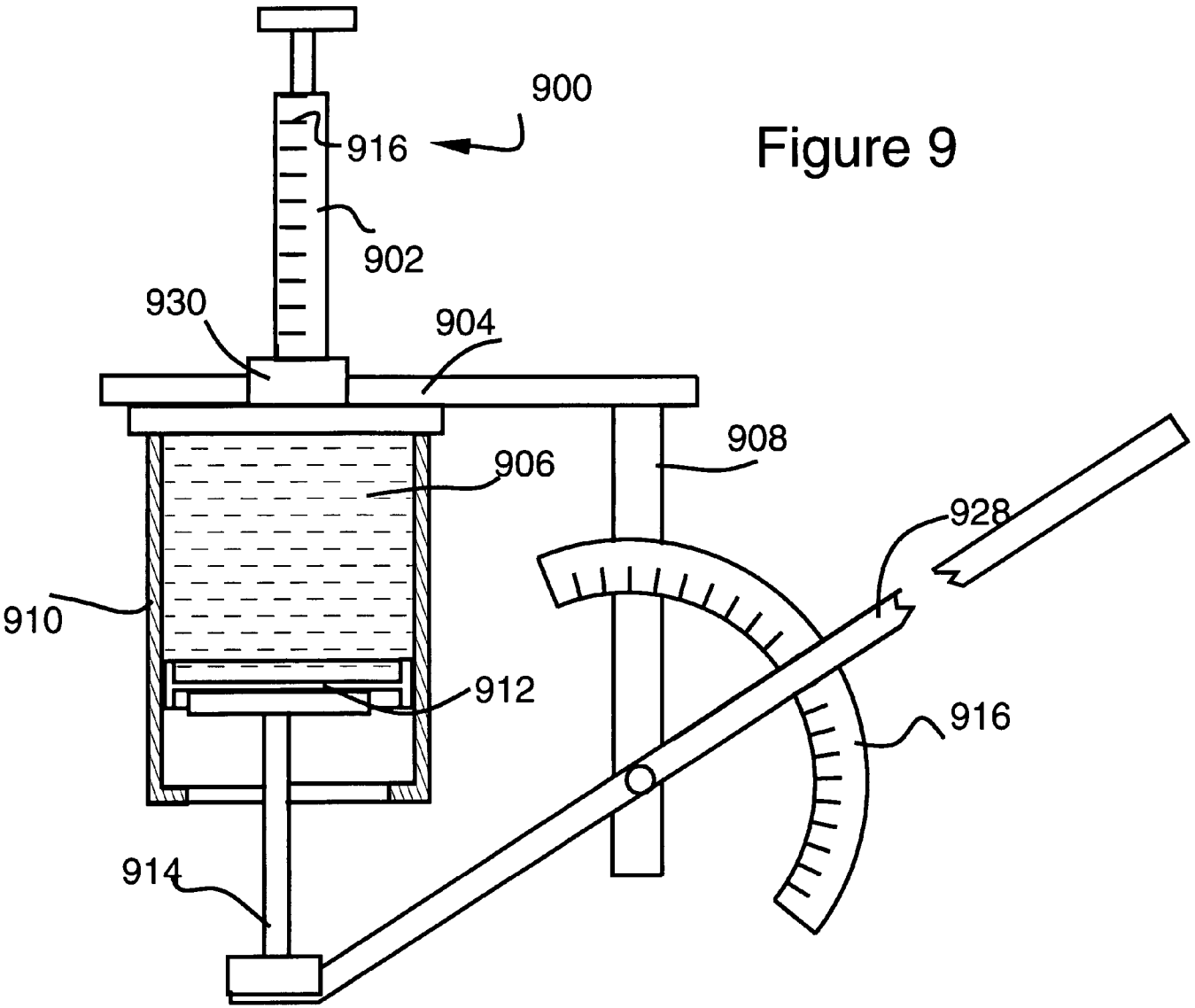
FIG. 9 is a schematic illustration of a system for transferring a measured dose from a master or supply container to a measured dose container.

In an example in which two increments of lever motion transfer a single dose of medication to the syringe 902, of FIG. 9, the lever mechanism must be designed to provide 60 incremental movements in order to fill thirty syringes. The thirty syringes can represent, for example, a thirty-day supply, or a fifteen-day supply of two applications per day. Preferably, the measured dose of product in each syringe provides for delivery of a single dose, but if desired, several doses can be contained within the measured dose receiver 902.

The piston mechanism of the present invention is adaptable for use with a grinding mechanism suited for pulverizing tablets, as noted above.

Figure 10:
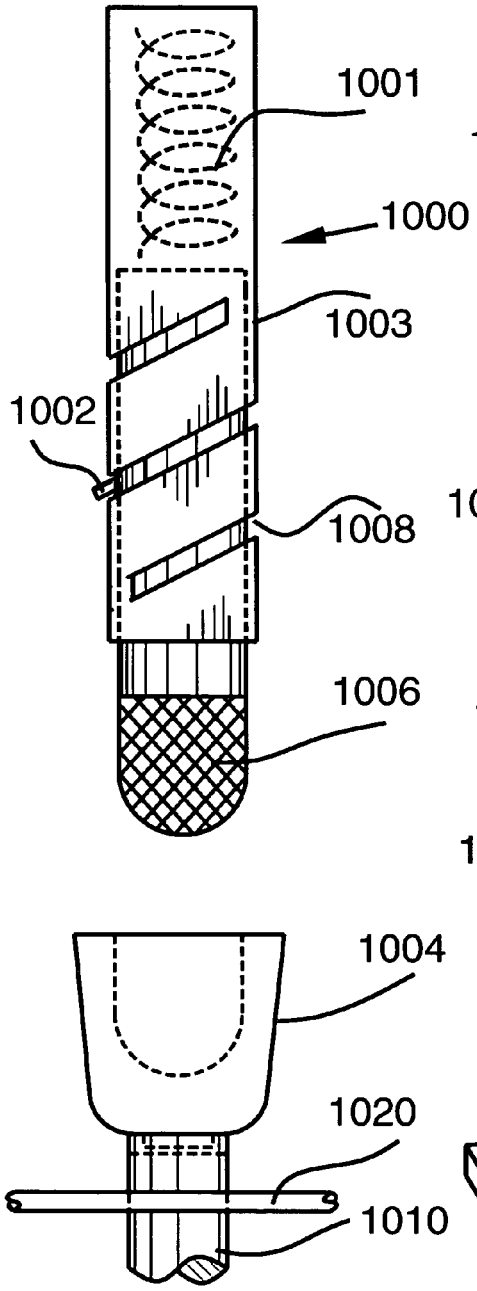
FIG. 10 is a front view of a grinding mechanism of the present invention.

The piston 1010 of FIG. 10 can be provided with a dovetail end for engaging with a mortar 1004. The same configuration can be provided with the mixing apparatus and thus the same mechanism can be used for driving the mixing apparatus and the grinding apparatus.

The pestle unit indicated generally as 1000 is provided with an internally mounted spring 1001 that drives the grinding bit 1006 downward. The pestle includes a hollow cylindrical member 1003 that houses the spring 1001 and the grinding bit 1006. A spiral channel 1008 guides the pin 1002 that is mounted on the grinding bit 1006 and travels with the grinding bit. It is noted that a structure such as the pin 1002 can also be referred to as a key.

Figure 11:
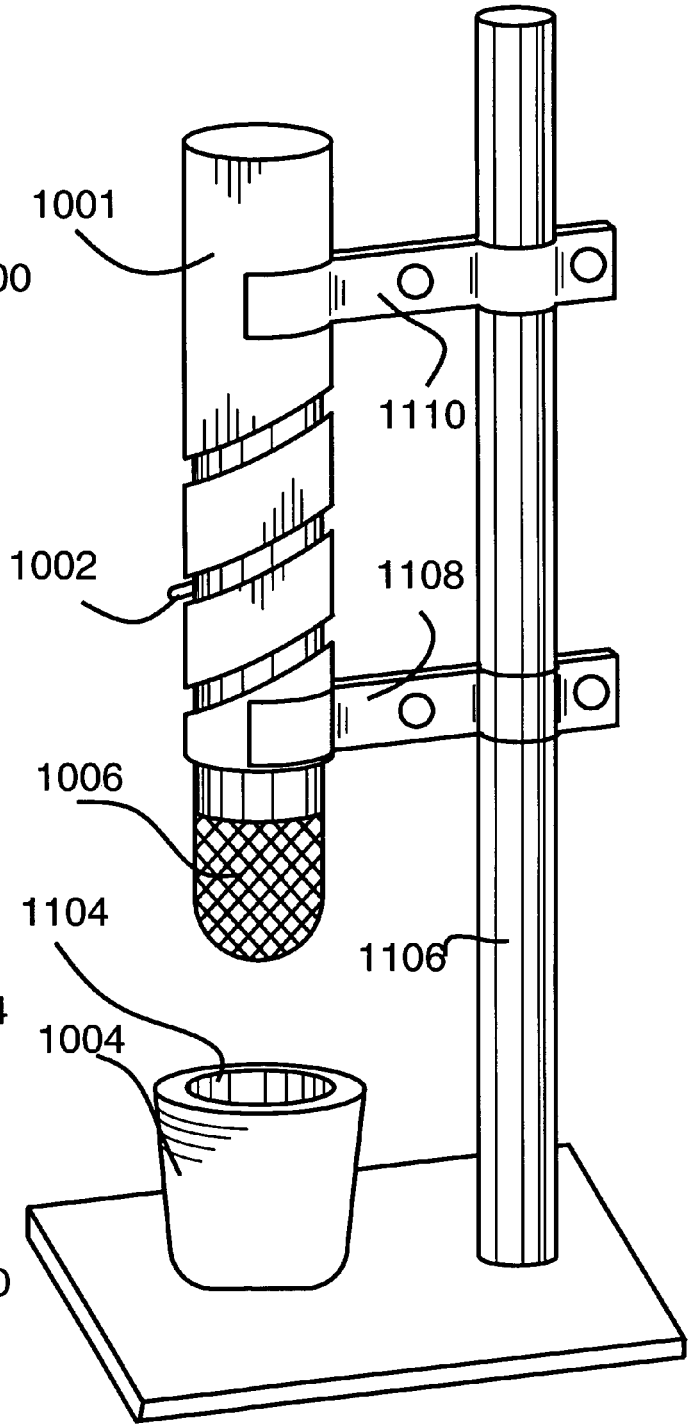
FIG. 11, is a perspective view of a grinding assembly.

As shown in FIG. 11, the hollow cylindrical body 1001 is supported on a standard 1106 that is fixed to the stand 1020. The stand 1020 is secured to a support surface such as a table by a clamping mechanism as well known in the art, or by any other convenient mechanism. The systems used in ammunition presses for supporting a press or securing a press to a table or the like, are suited for use with the structure of the present invention. The pestle is secured to the standard 1106 by clamping arms 1108 and 1110, or other convenient mechanism. Preferably, the clamping mechanism can be adjusted vertically along the standard 1106 in order to position the pestle at a desired distance from the mortar. Each of the clamping arms 1108 and 1110 are independently movable in order to accommodate pestles of varying lengths and diameters.

Figure 12:
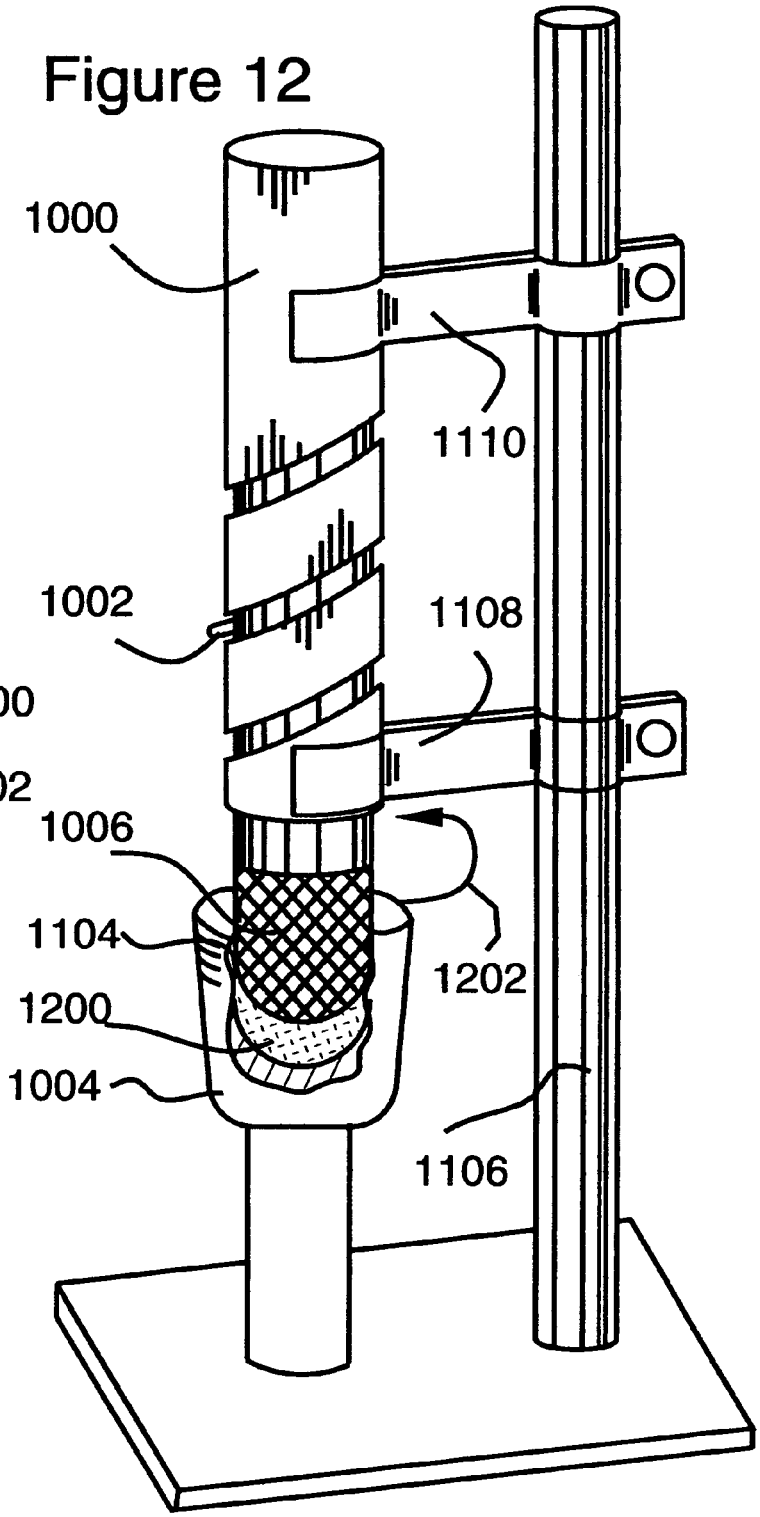
FIG. 12 is a perspective view of a grinder mechanism of the present invention.

The mortar 1004 has a hollow interior 1104 for receiving a substance that is to be pulverized. As shown in FIG. 12, the piston is elevated as describe above in relation to the mixing mechanism, thus compressing the pulverizable material 1200 between the mortar 1104 and the pestle 1006. The upward force of the piston lifts the mortar 1004 and forces the pestle 1006 upward. Since the pestle is keyed to the hollow cylindrical body 1001 of the pestle device 1000, the pestle is forced to rotate as it travels upwardly. In the embodiment of FIG. 12, the key 1002 travels within the channel 1008 and thus the grinding bit 1006 turns counterclockwise as indicated by arrow 1202. Obviously, the mechanism can be configured for clockwise upward rotation. When the piston is lowered, the mortar moves away from the grinding bit 1006 and the grinding bit rotates clockwise relative to the rotationally stationary mortar 1004. Thus, there is a rotational movement of the pestle relative to the mortar as the powder 1200 is compressed and pulverized. The piston is caused to rise and lower a sufficient number of times until the desired degree of comminution is attained. The movement of the piston is effected by a lever or motor, as described above.

Figure 13:
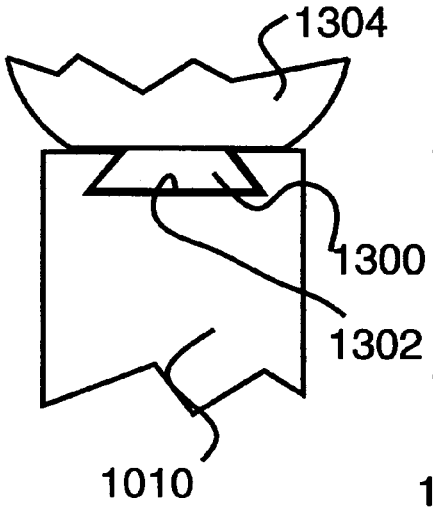
FIG. 13 is a fragmentary side view, partly in section, of a dove tail interlock.

FIG. 13 shows the mortar 1304 secured to the piston 1010 by means of a dovetail 1300 in a corresponding groove 1302. This is a representative example of an interlocking mechanism between the piston and the mortar. Equivalent interlocking mechanisms can also be used. A threaded connection can be used provided that the direction of rotation of the pestle during the grinding action is opposite the threading spiral of the connection, such that the grinding action tightens, rather than loosens the connection. Similarly a bayonet type of connection can be used.

Figure 14:
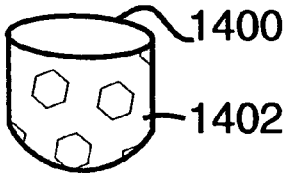
FIG. 14 is a perspective view of a disposable abrading surface.

The grinding bit 1006 can be enhanced through the use of a grinding cap 1400, as illustrated in FIG. 14. The grinding cap can be provided with projections 1402 that can be hard particles bonded to the exterior surface of the cap member 1400. The grit size, shape, and material can be a ceramic material or other inert abrading material, as well known in the art. Through the use of a cap on the grinding bit, the process is simplified since the cap can be disposable, thus reducing or eliminating a clean step. Conversely, the abrading material can be on the inner surface of the cap such that the cap 1400 functions as the mortar surface.

It should be understood that both a cap and a cup can be used. The cup can have a flat bottom so that it can positioned upright on a balance as a weight pan for crystalline product. The cup would then be placed into the mortar, with the weighed contents for reduction to a fine powder.

EXAMPLES

I prepare my own pluronic 20% and 30% gel. The concentration of drug to gelling material using the 20% gel cannot exceed 28% to 30% drug to pluronic solution. Using the 30% pluronic gel, the drug to gel can approach approximately 35%. The pluronic gel is a mixture of hydrophobic polymers and hydrophilic polymers. I use the following formula for mixing my pluronic gel.

Example I

To make 1 liter of 20% pluronic gel:

A) Make 1 liter of preserved purified water

1. Put 1000 ml Distilled Water in 1000 ml beaker
2. Add magnetic stir bar
3. Add the following preservatives and heat with stirring till dissolved:

| | |
|---|---|
| Methylparaben | 502 mg |
| Propylparaben | 254 mg |

B) To make the pluronic gel:

1. Determine amount of solute needed to make 1000 ml of 20% solution: 1000 ml×0.2=200 gm
2. Weigh out 200 grams of pluronic F127
3. Put the 200 grams of pluronic F127 in a 1000 ml beaker
4. Add sufficient preserved purified water to bring total volume to 1000 ml
5. Cover beaker (I use Saran Wrap) and store in refrigerator, stirring 2 or 3 times a day till solute is dissolved. This may take 2 or 3 days. Pour into plastic bottles for storage.
6. Can be stored at room temperature. Pluronic 20% gel is a gel at room temperature and becomes a liquid at refrigerator temperature. I store the quantity I plan to use within the next couple of days in the refrigerator so it will pour easily.

This product is commercially sold under the trademark Polox Gel 20% (Gallipot Chemical Co. NDC 51552-0549-8). Lipoil (lecithin isopropyl palmitate oil) is commercially available from Gallipot Chemical Co. NDC 51552-0550-8.

Example II

Procedure for making 100 mls of Seroquel 50 mg/l ml PLO:

Formula:

| | |
|---|---|
| Seroquel 100 mg tablets | #50 |
| Lipoil | 24 ml |
| Pluronic 20% qs ad 100 ml | approx. 75 ml |

Method:

Grind the 50 Seroquel 100 mg tablets in a Krups model 208B coffee mill for 2 bursts of 5 seconds, tapping the coffee mill between bursts to redistribute powder for more uniform grinding. Seroquel is film coated and I remove as many of the pieces of film coat as possible by using an ordinary stainless steel tea strainer. The tea strainer I use fits into the upturned lid of the coffee mill. Using the lid as a receptacle for the sieved powder, I dump the powdered drug from the coffee mill into the tea strainer. After a few quick taps to the rim of the sieve, the most finely ground powder sifts into the coffee grinder lid. Left in the sieve are pieces of film coat too large to pass through the sieve and particles of Seroquel drug that were not ground fine enough to pass through the sieve. The object is to reduce the drug to as fine a powder as possible.

The residue left in the sieve is put into a Wedgwood mortar and triturated using a Wedgwood pestle until the particles are barely, if at all, palpable. This product is again sieved and the residue, by this point consisting mostly of pieces of film coating, is discarded. The remaining powdered drug is returned to the Wedgwood mortar for a vigorous trituration to reduce all particles as fine as possible with manual trituration.

A Cito-Unguator brand mixer system was used to mix the ingredients. Unguator is a registered trademark of GAKO Konietzko GmbH. This system has proprietary plastic mixing jars of various sizes. For 100 ml batches I used the 100 ml-mixing jar which actually holds about 120 ml.

The volume of the jar is calibrated to 100 ml using 100 nm of water measured in a 250 ml glass graduate. These jars have a push up bottom and thus provide a piston like dispensing design.

Once the volume of the jar is calibrated, about 30 ml of pluronic 20% is poured into the jar. 24 ml of Lipoil is then added. 24 ml of Lipoil per 100 mls is the constant. To make a 50 ml PLO 12 mls of Lipoil is used. The powdered drug is then added. Pluronic 20% is then add to reach total volume of 100 ml. This is known as "the sandwich": a layer of pluronic, a layer of Lipoil, the drug, and pluronic as the final layer.

The jar is then attached to the Unguator mixer and mixed for about 30 seconds manually moving the jar up and down to assure complete mixing as the circular mixing blade remains horizontally stationary turning at about 3000 RPM. This machine is similar to a soda fountain milk shake machine.

The mixture in the jar is now a usable PLO, but there are still some visible and palpable particles of drug in the gel. To get the best bioavailability, the particles should be as fine as possible.

The next step is to run the mixture through an Exakt 50 ointment mill. This procedure not only eliminates any drug particles (powder nests), but the pressure involved chemically binds the drug to the lecithin which is the optimal goal for this drug delivery system.

After 2 passes through the ointment mill, the PLO is packaged into 20 ml syringes. These syringes are then dispensed to the patient.

Patient instructions may include:

1. Store the PLO at room temperature
2. Wear nylon or latex examination gloves when administering the gel. Otherwise the caregiver or the patient will absorb too much drug.
3. The PLO is mixed to deliver drug in dosing increments of 1 ml. The patient and or caregiver should be instructed how to determine what 1 ml is on the syringe.
4. The lecithin in the PLO is soy origin, so egg allergy is not a problem.
5. The best application sites are:
   a. The inner wrist(s)-Best because of thin skin and good blood supply
   b. The inner forearm(s)
   c. The inner thigh(s).

We have had patients using several PLOs utilize all of these sites.

There is no formula for conversion of dose from PO to PLO. Dosing is empirical. When we begin a patient on a PLO form of a PO drug, we start them at the PO dose. This has been successful about 95% of the time. Because of the fragile and failing nature of our patient population (hospice), it is sometimes necessary to adjust the PLO dose due to failure of organ systems including skin integrity and disease progression to brain, bone, liver and kidneys etc.

PLO drug administration eliminates first pass effect. All of the drug is distributed throughout the body without being metabolized first. As a side note, NSAIDs such as ketoprofen will still interfere with prostaglandin synthesis when given transdermally.

I have asked patients and caregivers if there is a film left after administration of the PLO. They report that there is nothing left on the skin except perhaps a slight stickiness. I had wondered if the excipients (the binders and fillers that hold the tablet together other than the active drug) would be transported along with the drug and I suspect they are.

The presence of the excipients when making PLOs from tablet or capsule powdered drug is the limiting factor on creating higher concentration/ml dosing formulas. The concentration of drug per ml of PLO could be much higher using pure drug (without the excipients).

Neuropathic Pain Gels

Amitriptyline 3.5%/Clonidine 0.02%/Guaifenesin 2%/Ketoprofen 5%

Neurontin 6%/Clonidine 0.2%

Ketoprofen 10%/Carbamazepine 2%/Lidocaine 10%

*Neurontin, Phenytoin or Amitriptyline may be substituted for Carbamazepine

Apply 1 ml to inner forearm (or affected area/dermatome) 4 times a day.

Nausea/Vomiting Gel

BDR Gel (Benadryl, Dexamethasone, Reglan)

Diphenhydramine 25%/Dexamethasone 4%/Metaclopromide 10%

Apply 1 ml to inner wrist qid for nausea/vomiting.

Appetite/Inflammation/Malaise Gel

Dexamethasone Sod. Phosphate 8 mg/1 ml (or any strength-4 mg/1 ml-2 mg/1 ml)

Apply 1 ml to inner forearm/affected area 1 to 4 times a day for (appetite/inflammation/malaise)

Shingles Gel

Ketoprofen 20%/Lidocaine 10%/Carbamazepine 2%

Apply 1 ml to affected area 3 times a day. Wash area before each application.

Inflammation in the Joints/Bone Pain Gel

Ketoprofen 20% gel (200 mg/1 ml)

Ketoprofen 10% gel (100 mg/1 ml)

Apply 1 ml to (dermatome, knee, scapula, affected area) up to qid for pain.

Agitation Gel

Lorazepam 1 mg/1 ml gel

Apply 1 ml to inner forearm (HS for sleep or up to q4-6h prn agitation)

Aggressiveness Gel

Haloperidol 1 mg/1 ml gel

Apply 1 ml to inner forearm 1 to 4 times a day for aggressiveness or agitation

Miscellaneous Gels

Keto-Flex gel (Ketoprofen 20%, Cyclobenzaprine 2%)

Keto-Lido gel (Ketoprofen 20%, Lidocaine 5%)

KetoCycloLido gel (Ketoprofen 20%, Cyclobenzaprine 2%, Lidocaine 5%)

Or any combination. Apply 2 to 4 times a day or as needed to the affected area.

Rub in well.

Components of the PLO Gel System

FIG. 15 illustrates a Luer to Luer connector with full-length threads 1590 for better connection between syringes when using the devices of the present invention. The term "Luer" or "Luer connector" refers to a threaded device that is typically used to connect a needle to a syringe, a pair of syringes, but is inclusive of connectors between any two threaded members. The barrel 1591 of the connector can be finished for better gripping and handling. The surface can be knurled and the barrel can be circular in cross-section or can have a plurality of sides, as for example, five, six, or seven sides. FIG. 16 shows the cross-section of the Luer to Luer connector. The hole 1593 through the connector provides for product passage between containers. The containers have corresponding internal threads to cooperate with the external threads 1590 of the Luer connector 1591. FIGS. 17 and 18 show the passage 1593.

FIG. 19 illustrates another embodiment of a Luer connector 1990 that is designed to transfer product from a Luer tip syringe to a commercially available push-up-bottom mixing jar. A full length double lead Luer connector 1991 is provided. The internal threads 1992 receive the threads of ajar lid. An orifice 1993 is provides for passage of product through the connector 1990. FIG. 21 shows the threaded connector 1991 and FIG. 22 shows the open region of the female threads 1992 for receiving the external threads of a jar lid or lip.

Figure 23:
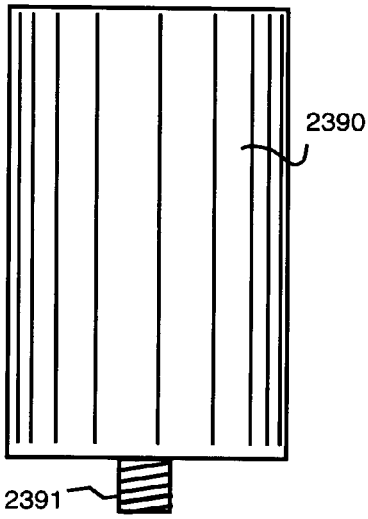
FIG. 23 is a side view of another embodiment of a Luer connector.
Figure 24:
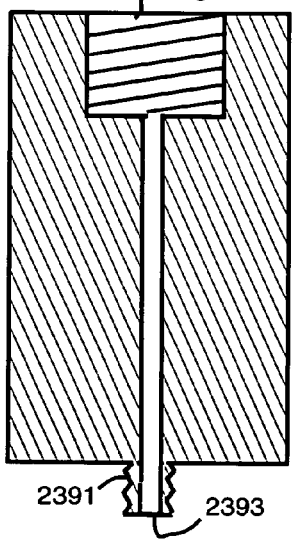
FIG. 24 is a cross-sectional view of the Luer connector of FIG. 23.
Figure 25:
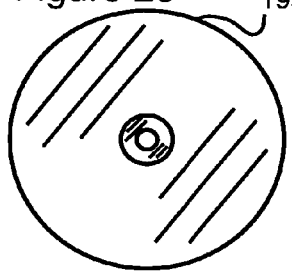
FIG. 25 is a top view of the Luer connector of FIG. 23.
Figure 26:
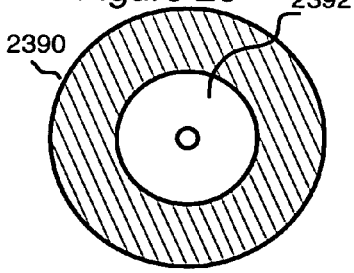
FIG. 26 is a plan view, in cross-section of the Luer connector of FIG. 23.

FIG. 23 shows a connector 2390 that is designed to transfer product from a Luer tip syringe to fill an ointment tube. The design is similar to that of the connector of FIGS. 19 through 22, but may not provide as wide an internal thread 2392 diameter as required for ajar connection as shown in FIG. 20. The barrel of the connector 2390, as is true for each of the Luer connectors, can be variously finished and shaped for ease of handling, as noted above. The Luer threads 2391 are full-length double lead threads. The female threads 2392 are tooled to accommodate the threads of the desired brand or design of ointment tube. FIG. 25 shows the external thread end of the connector 2390 and FIG. 26 shows the female thread 2392 end of the connector 2390. Typically, the diameter of the female threaded opening 2392 for an ointment tube is substantially less than the diameter required for the jar accommodating female threads 1992 of FIG. 20. The ointment tube can be of any design as well known in the art and readily commercially available. Typically, the ointment tube has a narrow threaded proximal end that accommodates a threaded closure cap and an open distal end that is sealed after the tube is filled. Closure of the ointment tube is accomplished, as well know in the art, by folding and crimping, fusing, or other desired means. The ointment tube can be in a form characteristic of tooth paste tubes.

Figure 27:
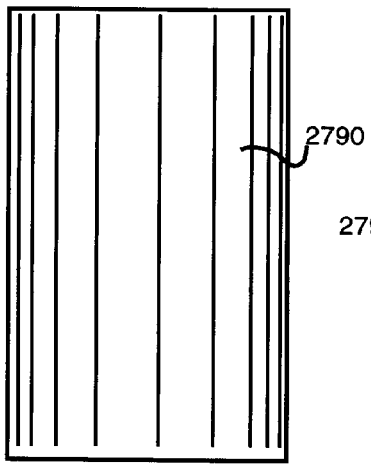
FIG. 27 is a side view of another embodiment of a Luer connector.
Figure 28:
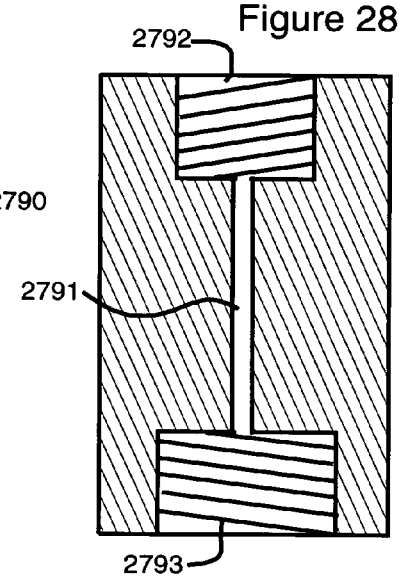
FIG. 28 is a cross-sectional view of the Luer connector of FIG. 27.
Figure 29:
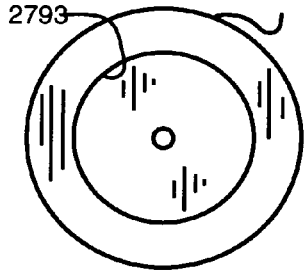
FIG. 29 is a bottom view of the Luer connector of FIG. 27.
Figure 30:
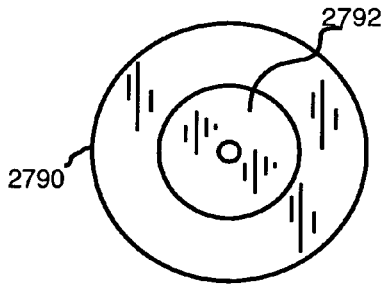
FIG. 30 is a top view, in cross-section of the Luer connector of FIG. 27.

FIG. 27 shows a Luer connector 2790 that is internally threaded at each end, as indicated by female threads 2792 and 2793. The connector 2790 is used to transfer product from a push-up-bottom ointment jar to fill an ointment tube. The female threads 2793 of the ointment supply jar can be of a substantially greater diameter than the internal threads 2792 provided for receiving the ointment tube. The product is transferred from the supply jar to the ointment tube through the orifice 2791. As previously noted, the threads can be tooled to accommodate any desired model, design, or brand of push-up-bottom ointment jar and ointment tube. The push-up-bottom ointment jar as noted for example in FIG. 9, can have a flat bottom that serves as a piston to force product from the ointment supply jar to each single or multiple dose ointment tube. A multiple dose ointment tube can be used where a supply jar is used to fill a plurality of ointment tubes for different patients. In such an example, each ointment tube would contain a plurality of doses. The ointment tube thus provides for repeated use over a period such as a week, several weeks, a month, etc. The single dose application is preferred however, particular where accuracy is required with respect to the amount of PLO gel applied to a patient. A variation in concentration of delivered active ingredient can be experienced if the amount of ointment that is applied to the skin of the patient varies between applications. The single dose design, in particular, the single dose syringe is preferred because of the high consistency of product delivery that can be achieved through its use.

FIG. 31 shows a connector 3190 for transferring product from a push-up-bottom ointment jar to fill oral syringes. FIG. 32 show the internal passage way 3191 having a tapered end 3192 to fit the tapered tip of commercially available oral syringes. The female threads 3193 are provided for attaching the connector of the lid of a push-up-bottom jar to fill the oral syringe with product. FIG. 33 shows the passage 3191 through which product is transferred from the supply jar to the oral syringe, and the tapered outlet end 3192 which conforms to the shape of the end of an oral syringe.

FIG. 35 shows a piece of glassine or thin flexible plastic 3590, that can be used to label jars or bottles of compounded medicine or other product. The labels can be written on with an indelible ink and serve to identify the contents of each of a plurality of different containers of the same type. One attribute of the labels is that they can remain on the bottles and can remain readable after hot water bath immersion. The hole 3591 enables the label to be used on the neck of amber ovals. Amber ovals, refers to the common brown bottles in which liquid medicine can be dispensed.

FIG. 36 show a volume measuring stick 3690 that can be made from plastic, metal or other durable material. The purpose of the stick is to accurately determine the volume of liquid in a cylinder or jar. To use the measuring stick, the user places notch A 3691 on the rim of the jar that is to be used. The stick 3690 is laid on a diameter across the top of the jar. The far rim of the jar should fall into one of a plurality of notches 3692 identified as B and C, etc. The stick 3690 can be clipped to the inside of the jar so that both hands can be used for stirring and filling to a mark on the stick in order to achieve an exact volume of product in the jar. The numbers 3694 on the left side of the stick correspond to the notch C and the numbers 3693 on the right side of the stick correspond to the notch B. Since the distance between notches A and B is less than the distance between notches A and C, it takes a greater height of liquid in the A-B size to provide an equal volume to the A-C jar.

INDUSTRIAL APPLICABILITY

The system of the present invention performs many tasks associated with the compounding of medication and the mixing of chemicals in the pharmacy, hospital and laboratory, as well as the filling of unit dose dispensers. The structures and methods of the system have general applicability in other applications.

The Basic Functions of the Invention are to:

1. Mix liquids with liquids
2. Mix liquids with powdered drugs or chemicals
3. Disperse (homogenize) liquid or powdered drug or chemical into gels, ointments, creams, colloids, emulsions etc.
4. Fill unit of use syringes (unit-dose syringes)
5. Fill ointment tubes
6. Dilute stock concentrations of a compounded product to any lesser strength accurately and easily
7. Transfer compounded product from syringes to syringes
8. Transfer compounded product from syringe to jar
9. Transfer compounded product from jar to syringe
10. Grind drug or chemical crystals, powders, tablets to a fine powder

Mix Liquids with Liquids

The term emulsion as used herein refers to particles of one liquid finely dispersed in another liquid. Many oral mouthwashes are composed of several liquids added together. Each liquid ingredient will have its own viscosity (viscosity is that property of fluids by virtue of which they offer resistance to flow). Some liquids are thin and runny, like water or alcohol. Some have a consistency like grape jelly. Some have the consistency of thick honey.

It is the responsibility of the pharmacist to mix the prescribed ingredients together well using whatever means he has knowledge of and access to. The compounded product is said to be "pharmaceutically elegant" when its overall consistency, color, taste and feel, if applicable, presents a pleasing and uniform mixture or texture with no separation of products (does not separate into liquids and solids or two or more different liquids). The more thoroughly the liquids are mixed, the more stable and elegant the product becomes.

The greater the extent to which the liquids are homogenized, the more accurate will be the dosing of the product. The intent of the prescriber and the pharmacist is that each unit of measure (each teaspoonful, for example) of the product contain the same amount of active drug. In other words, if the concentration of the compounded mixture is 10 mg of drug in every teaspoonful, then the first teaspoonful poured from the bottle should contain 10 mg of drug and the last teaspoonful poured from the bottle should also contain 10 mg of drug. If the product is not properly mixed, the drug may settle more quickly to the bottom of the bottle by force of gravity. This can yield a dose of less than 10 mg in the first teaspoonful poured from the bottle and, toward the bottom of the bottle, the concentration could grow to an undesirable level as the drug settles and concentrates in the last few doses.

The term homogenize, as used herein, refers to the use of force and pressure to break up globules and powder nests and disperse all ingredients uniformly throughout the product. The term powder nests refers to clumps of powder that must be broken up and for uniform dispersal throughout the product.

Formula for Mouthwash Containing 3 Liquids of Different Viscosity:

| | |
|---|---|
| Liquid antacid | 40 ml |
| Viscous lidocaine 2% | 40 ml |
| Nystatin oral suspension | 40 ml |

This formula is often used for patients who have a lowered resistance to infection due to illness, radiation therapy or chemotherapy. It is used to treat fungal infections of the mouth and decrease the pain associated with diseased or burned oral mucosa to enable a patient to eat, drink and talk without extreme pain.

Liquid antacid can be a thin, runny liquid that has the appearance of skim milk, but has the consistency of water. It contains magnesium hydroxide and aluminum hydroxide. Because water is the main ingredient, the magnesium and aluminum tend to quickly settle to the bottom of the bottle and cake or become a hard mass. Liquid antacids should always be shaken very well before each use to suspend the magnesium and aluminum hydroxides.

Viscous lidocaine 2%, as its name implies, is viscous. It is clear and has a consistency and viscosity similar to a semi congealed gelatin dessert. Viscous lidocaine 2% is relatively difficult to uniformly disperse into solutions. It tends to form random, stringy globules which are visually unattractive and which present a therapeutic dilemma when the goal is uniformity in the dispersion of drugs within the compound.

Nystatin oral suspension is a yellow liquid with the consistency of table syrup. Yellow nystatin powder is held in dispersion by the viscosity of the syrup.

The most used and fastest method for mixing this common compound has been is to add equal parts of each ingredient directly into a bottle, shake well and dispense. As can be imagined from the above discussion, there will be some mixing of the ingredients, but the viscous lidocaine will remain in rather large globules and the nystatin will begin to migrate toward the bottom of the bottle as will the magnesium and aluminum hydroxides. There are issues with the accuracy of the volume markings on most pharmaceutical bottles designed for dispensing. This means that simply pouring each ingredient into the bottle up to a milliliter mark or ounce mark could be off by several milliliters. If each ingredient is measured into accurately calibrated graduates, the accuracy of the measure becomes greater, but the amount of dishes to wash and the time consumed in measuring and pouring becomes greater.

The greater the extent to which product is mixed, shaken or homogenized, the smaller the particles of each drug ingredient become. The smaller the drug particles become, the better they stay dispersed in the solution. The more uniform the dispersion of particles, the more uniform is the accuracy of the dose per volume of measure.

The present system offers an easy way to quickly and accurately measure and homogenize this preparation.

The present system employs a rotatable bar or arm that is attached to a stanchion. Supports on the rotatable bar or arm are adjusted to hold the flanges of two 140 ml syringes. The plunger is extracted from one of the syringes and laid aside. The plunger of the other syringe is pushed all the way in. These two syringes are connected tip to tip with a Luer to Luer connector.

The rotatable bar or arm is placed in a vertical position and the syringe flanges are inserted into the supports. The uppermost syringe is the syringe with no plunger (piston) and the bottom syringe has its plunger (piston) still in it. The liquids are poured into the top syringe in any order. The markings on the syringe are very accurate. In this formula, we are using 40 ml of each of three ingredients. The first liquid is poured in until the level of liquid is even with the 40 ml mark on the barrel of the syringe. The second liquid is poured in until the level of liquid reaches the 80 ml mark. The third liquid is poured in until the level of liquid reaches the 120 ml mark.

The piston is then reinserted into the top syringe. The problem encountered in this procedure is that there may be a lot of air trapped between the end of the piston and the product (in this case the liquids).

The present invention can employ a unique air elimination device, that is inserted into the barrel of the upper, open syringe. This device consists of three strands of approximately 1 mm fly-fishing line. The three strands are approximately 12 inches long and are secured at one end with a loop or handle. The loose ends of the device are lowered into the barrel of the syringe and allowed to touch the product, which is ready to be mixed. The piston is inserted into the barrel of the syringe and, as it is pushed down, the trapped air escapes through the creases that are made in the rubber of the piston seal as they slide along the fishing line device. When the piston has been inserted until there is little or no air left between it and the product, the string device is removed from the barrel by simply pulling it out. The piston seal is restored and the air removal operation is complete. The product is now ready for mixing.

The proper size shoe is inserted into the top of the piston. This is the size that matches the surface area of the thumb grip, or end, of the piston. The rotatable bar or arm is rotated 180 degrees so that the loaded syringe is on the bottom.

The levers are then pulled forward until the piston shoe makes contact with the thumb grip of the plunger of the lower syringe. Pulling the levers with gentle steady pressure, the plunger (piston) of the lower syringe compresses the product in the syringe until the contents of the lower syringe are expelled through the Luer to Luer coupler into the upper syringe. The levers are returned to the upright position. This lowers the piston shoe to allow the rotatable arm to be rotated for the next cycle.

The rotatable arm is rotated 180 degrees to place the newly loaded syringe in the bottom position. The term loaded syringe as used herein refers to the syringe that contains product. The levers are pulled forward until the piston shoe makes contact with the thumb grip of the plunger of the lower syringe.

The above described process is repeated several times, preferably at least four or five times to produce a uniform mixture. The number of times the process must be repeated is dependant upon the uniformity requirement and the nature of the ingredients of the mixture.

Mix Liquids with Powdered Drugs or Chemicals

This function includes such materials as colloids and gels, such as Pluronic Lecithin Organogels or other transdermal gels The term colloids as used herein refers to a state of matter in which finely divided particles of one substance (the disperse phase) are suspended in another (the dispersion medium).

Pluronic Lecithin Organogels, referred to herein as PLO gels or transdermal gels, consist of granular soy lecithin dissolved in isopropyl palmitate, mixed with pluronic F-127 (a polyethylene glycol) that has been hydrated in water to a concentration of 20% to 30% and active drugs and diluents as required.

Formula for Formulating a PLO Containing Ketoprofen 10% (A Non-Steroidal Anti-Inflammatory drug):

This transdermal gel formula is most generally used for bone pain associated with breaks, metastases to the bone and arthritis pain. It is usually mixed at a concentration of 100 mg or 200 mg per milliliter. A dose of 1 milliliter is applied to the inner wrist and rubbed in well. The maximum dose of ketoprofen is said to be 300 mg per day. The caregiver should wear vinyl or latex examination gloves when administering the drug to avoid absorbing the drug.

| 100 milliliters of ketoprofen 10% PLO | |
|---|---|
| Ketoprofen powder | 10 Grams |
| Lecithin solution | 24 milliliters |

Pluronic F-127 20% to Volume of 100 ml

The system of the present invention is configured as above with two 140 ml syringes connected Luer to Luer. One syringe has the plunger removed and the other has its plunger pushed all the way in. The syringes are mounted in the supports of the rotatable arm. The open syringe is on the top and the syringe with its plunger completely inserted is on the bottom. The syringes are in a vertical line. The top syringe is open and ready to have ingredients poured into it.

Accurately weigh 10 Grams of ketoprofen powder and set aside. Pour 30 ml of pluronic F-127 into the top syringe. Pour 24 ml of lecithin solution into the syringe. 24 ml per 100 ml of PLO is the constant in PLO formulas. This can either be measured in a graduate and poured into the syringe, or poured directly into the syringe using the measure markings on the syringe. The ketoprofen powder is then added to the syringe.

In order to arrive at a total volume of 100 ml, the ketoprofen powder must be "wetted". The term wetting, as used herein, refers to a process of mixing the powder and liquids together to surround the particles of the ketoprofen powder with a film of liquid. This decreases the volume of the mixture by eliminating air that had been surrounding the particles of powder. This preliminary mixing can be accomplished with a glass rod. The glass rod is inserted into the open end of the syringe and the mixture is stirred until it resembles thick pancake batter. After the larger lumps of powder have been broken up and the mixture is relatively smooth, the glass rod is withdrawn with a twirling motion against the inner surface of the barrel of the syringe. This cleans most of the product from the rod. Pluronic F-127 liquid is then poured into the open end of the syringe until the level of liquid is at the 100 ml mark on the barrel of the syringe.

The plunger is inserted using the above describe venting device to vent the trapped air. The piston is then reinserted into the top syringe. The piston is inserted into the barrel of the syringe and, as it is pushed down, the trapped air escapes as described above. When the piston has been inserted until there is little or no air left between it and the product, the venting device is removed from the barrel by simply pulling it out and the piston seal is restored. The air removal operation is complete and the product is now ready for mixing.

The proper size shoe is inserted into the top of the piston, as described above. The rotatable are is rotated 180 degrees so that the loaded syringe is on the bottom. The levers are then pulled forward (toward the operator) until the piston shoe makes contact with the thumb grip of the plunger of the lower syringe. Pulling the levers with gentle steady pressure, the plunger (piston) of the lower syringe compresses the product in the syringe until the contents of the lower syringe are expelled through the Luer to Luer coupler into the upper syringe. The levers are returned to the upright position. This lowers the piston shoe to allow the rotatable arm to be rotated for the next cycle.

The rotatable arm is rotated 180 degrees to place the syringe loaded with product in the bottom position. The levers are pulled forward until the piston shoe makes contact with the thumb grip of the plunger of the lower syringe. The above process is then repeated several times as noted above.

Adding Liquids or Powders to Creams or Ointments

Making a 120 Gram Benzocaine Ointment 2%

For a total volume of 120 ml, subtract 2% of 120 (2.4) from 120 to get 117.6 Grams. White petrolatum is the ointment base of this example. 117.6 Grams of white petrolatum is accurately weighed and set aside. 2.4 Grams of benzocaine is accurately weighed and set aside. The device of the present invention is configured as above with two 140 ml syringes connected Luer to Luer. One syringe has the plunger removed and the other has its plunger pushed all the way in. The syringe flanges are mounted in the supports of the vertically positioned rotatable arm. The open syringe is on the top and the syringe with its plunger completely inserted is on the bottom. The syringes are in a vertical line. The top syringe is open and ready to have ingredients poured into it. The white petrolatum is too viscous to pour and thus is scooped into the open syringe using a spatula. The petrolatum is worked to the bottom of the syringe using a glass rod. Benzocaine powder is poured into the syringe and gently stirred into the petrolatum using the glass rod. After the larger lumps of powder have been broken up and the mixture is relatively smooth, the glass rod is withdrawn with a twirling motion against the inner surface of the barrel of the syringe. This cleans most of the product from the glass rod.

The plunger is inserted using the venting procedure described above to vent the trapped air. The product is now ready for mixing.

The proper size shoe is inserted into the top of the piston and the rotatable arm is rotated 180 degrees so that the loaded syringe is on the bottom. The levers are then pulled forward (toward the operator) until the piston shoe makes contact with the thumb grip of the plunger of the lower syringe. Pulling the levers with gentle steady pressure, the plunger of the lower syringe compresses the product in the syringe until the contents of the lower syringe are expelled through the Luer to Luer coupler into the upper syringe. The levers are returned to the upright position as previously described.

The rotatable arm is rotated 180 degrees to place the loaded syringe in the bottom position. The levers are pulled forward until the piston shoe makes contact with the thumb grip of the plunger of the lower syringe. The above process is then repeated as described above.

Filling Unit-Dose Syringes from 140 ml Syringe

Filling unit-dose syringes is a tedious process that usually involves transferring the product from a storage or mixing container to a syringe so that the patient or caregiver can accurately measure the dose. There are commercial pumps that can fill syringes with liquids, but they are expensive and only work to dispense liquids. They cannot handle viscous products such as PLOs, gels, ointments and creams.

Filling a 1 ml Unit-Dose Syringe with PLO from a 140 ml Mixing Syringe

After mixing the PLO in the above example, 100 oral 1 ml syringes are filled for use for in topical administration. The procedure of the present invention is as follows:

Remove the 140 ml syringes from the supports on the rotatable arm. Disconnect the two syringes from each other. In the place of the Luer to Luer connector attach a Luer to Oral Slip connector to the loaded syringe. Luer to Oral Slip connectors are commercially available. Align the rotatable arm in a vertical position and install the flange of the loaded syringe into the bottom support with the Oral Slip connector pointing upward.

Gently pull the levers toward the operator until the shoe on the piston touches the thumb pad of the syringe. Continue pulling the levers toward the operator, applying gentle pressure on the thumb pad of the syringe plunger to compress the PLO in the barrel of the syringe until product is visible in the orifice of the connector. Return the levers to the upright position to lower the piston of the machine and stop the flow of product into the connector. Insert the oral tip of a 1 ml oral syringe into the Oral Slip connector. Give the 1 ml oral syringe a gentle downward twist to seat it in the connector. Pull the handles gently toward the operator until the piston shoe gently touches the thumb pad of the 140 ml syringe. Continue gentle pressure as product is transferred from the 140 ml syringe to the 1 ml oral syringe until product fills the oral syringe to the 1 ml mark. Return the levers to the upright position to relieve pressure on the syringe and its contents. Remove the oral syringe with a gentle upward twist. Cap and label the oral syringe. Insert the oral tip of another oral syringe into the Oral Slip connector and repeat the process until all 100 oral syringes are filled.

Filling 1 ml Unit-Dose Syringes from a Push-Up-Bottom Jar

Product in a commercially available push-up-bottom jar can easily be transferred directly to unit dose syringes using the system of the present invention. In cases in which a high pressure is needed to push up the bottom of the piston type jar, a shoe can be used that inserts on the top of the machine's piston. This shoe not only accommodates the protrusion in the middle of the piston base of commercially available jar's, but also provides uniform pressure over most of the surface area of the piston. The even distribution of pressure minimizes warping of the piston base under pressure, and greatly decreases leakage around the piston seal.

An attachment that fits into the bottom support on the rotatable arm can be used to provide support over the surface of the lid of the jar as the contents of the jar are subjected to the pressure needed to expel the contents through the nozzle that is in the middle of the lid of the jar. To transfer product from push-up-bottom jars to unit dose syringes, the nozzle in the lid of the jar is fitted with a unique connector that is threaded to fit the nozzle on one end and has a tapered orifice to accept the taper of the tip of the oral unit dose syringe on the other end.

The jar fitted with the tapered orifice connector, is placed on the work surface of machine of the present invention and centered over the piston of the machine. The rotatable arm is in the vertical position and with the jar lid support attachment inserted into the lower rotatable arm support, is lowered until the jar lid support attachment rests firmly on the lid of the jar. The connector is protruding upward through the attachment.

An empty unit dose syringe is now inserted in to the tapered receptacle with a gentle downward twist into the connector. Gently pull the levers of the machine toward the operator until the shoe of the piston makes contact with the bottom of the jar. The position of the plunger in the unit dose syringe is monitored the levers are pulled to force product from the jar into the unit dose syringe until the desire number of milliliters has been transferred.

To terminate the filling process, the levers are returned to the upright position. This lowers the machine's piston, relieving pressure on the bottom of the jar and stopping the product from being expelled from the jar into the connector. The unit dose syringe is gently twisted while lifting to remove it from the connector. The unit dose syringe is then capped and labeled for dispensing and the next empty unit dose syringe is inserted into the connector to be filled in the same manner.

Filling 30 Gram Ointment Tubes from Mixing Syringe

The procedure is as follows:

Remove the 140 ml syringes from the supports on the rotatable arm. Disconnect the two syringes from each other. In the place of the Luer to Luer connector attach a Luer to ointment tube connector to the loaded syringe. Align the rotatable arm vertically and install the flange of the loaded syringe into the bottom support with the connector pointing up.

Screw the cap end of an ointment tube into the connector. Gently pull the levers of the machine toward the operator until the shoe of the piston touches the thumb pad of the syringe plunger. Determine from the milliliter markings on the syringe barrel the number of milliliters of product in the syringe. For example if the volume of product in the syringe is 100 mls and 30 ml of product is to be transferred to the ointment tube, the levers will be gently pulled toward the operator until 30 mls have been expelled into the ointment tube. The plunger of the syringe will now be on the 70 ml mark to indicate that 30 mls of product has been transferred. (30 ml=approximately 30 Grams).

The ointment tube is now unscrewed from the connector, the cap is replaced on the ointment tube and the open end of the ointment tube is sealed. Since the tube is filled from the threaded connector side, the open end is free of ointment and the tube can readily be sealed by a welding process such as thermal, sonic or other fusing process.

Current methods for transferring product to ointment tubes generally require filling a cake decorating type bag with the product and squeezing the product into the open end of a vertically stabilized ointment tube by twisting the bag. Disadvantages of this procedure include waste of product which will inevitably be lost in the bag, unknown quantity of product being transferred to the ointment tube, air pockets being produced due to the uneven settling of product in the tube, product soiling crimp area which must be cleaned well for proper sealing. By way of contrast, the system of the present invention wastes no product, transfers exact volume of product to the dose tube, air pockets are virtually eliminated and the crimp area is not soiled.

Filling Ointment Tubes from Push-Up-Bottom Jars

As previously described, a shoe that inserts on the top of the machine's piston can be used to distribute pressure uniformly over most of the surface area of the piston. The even distribution of pressure minimizes warping of the piston base under pressure, which greatly decreases leakage around the piston seal. An attachment can be provided that fits into the bottom support on the rotatable arm that is designed to provide support over the surface of the lid of the jar as the contents of the jar are subjected to the pressure needed to expel the contents through the nozzle that is in the middle of the lid of the jar.

To transfer product from push-up-bottom jars to ointment tubes, the nozzle in the lid of the jar is fitted with a connector that is threaded to fit the nozzle on one end and has female threads to accept the cap end of ointment tubes on the other. The jar, fitted with the connector, is placed on the work surface of machine of the present invention and centered over the piston of the machine. The rotatable arm is in the vertical position and with the jar lid support attachment inserted into the lower arm support, and is lowered until the jar lid support attachment rests firmly on the lid of the jar. The connector is protruding upward through the attachment.

An empty ointment tube is now screwed into the connector. The levers of the machine are gently pulled toward the operator until the shoe of the piston makes contact with the bottom of the jar. The operator may look down into the open end of the ointment tube and continue to pull the levers to force product from the jar into the ointment tube. Since there is at this time no way of know precisely how much product has been transferred into the tube, the correct volume must be estimated and the filling process terminated when the tube is estimated to be sufficiently filled. To terminate the filling process, the levers are returned to the upright position. This lowers the machine's piston, relieving pressure on the bottom of the jar and stopping the product from being expelled from the jar into the connector. The ointment tube is now unscrewed from the connector, the cap is replaced on the ointment tube and the open end of the ointment tube is sealed.

Dilute Stock Concentrations of Product

Often a particular compound will be ordered again and again, but each time, the prescriber may prescribe a slightly different strength from what may be available. The solution to this problem is to make a quantity of the product at the highest strength written for and dilute a portion of it as needed for each prescription.

This example shows a supply in inventory of 100 ml of morphine-20 mg/1 ml PLO in the 140 ml syringe in which it was mixed. Also available are several hundred milliliters of PLO that has no drug added (Plain PLO).

In this example a prescription has been received for 100 ml of morphine 5 mg/1 ml PLO. The requirement is thus 500 mg of morphine in 100 ml of PLO to make 5 mg/1 ml. Dividing 500 mg by the 20 mg per ml that is the stock morphine PLO, indicates that 25 ml of the 20 mg/1 ml stock morphine PLO is needed to supply the 500 mg of morphine.

The Dilution Method is as Follows:

The 140 ml syringe containing the morphine 20 mg/1 ml PLO is fitted with a Luer to Luer connector. An empty 140 ml syringe with its plunger fully depressed is attached to the Luer to Luer connector. The flanges of these two syringes are fitted into the supports of the rotatable bar that is adjusted to be in a vertical position with the syringe loaded with product in the bottom position.

The levers of the machine are pulled gently toward the operator until the shoe that is fitted on the tip of the machine's piston comes into contact with the thumb plate of the plunger of the lower, loaded syringe. With a gentle, steady pressure the levers are pulled until 25 ml of the morphine 20 mg/1 ml is transferred into the upper syringe. The levers are returned to the upright position, which lowers the machine's piston and relieves pressure on the bottom syringe plunger. This stops the flow of product from the lower syringe to the upper syringe. The syringes are removed from the arm supports. The stock morphine syringe is removed from the connector and capped. A 140 ml syringe containing plain PLO is attached to the connector. The flanges of the two syringes are inserted into the supports of the vertical rotatable arm with the plain PLO syringe on the bottom. The levers of the machine are pulled gently toward the operator until the shoe that is fitted on the tip of the machine's piston comes into contact with the thumb plate of the plunger of the lower (loaded) syringe. With gentle, steady pressure the levers are pulled until 75 ml of the Plain PLO is transferred into the upper syringe.

The two syringes are removed from the supports and the syringe containing the plain PLO is removed from the connector and replaced with an empty syringe, the plunger of which was fully depressed before connecting to the connector. The flanges of these two syringes are inserted into the supports of the rotatable arm or bar, with the loaded syringe on the bottom. The levers are then pulled forward, toward the operator, until the piston shoe makes contact with the thumb grip of the plunger of the lower syringe. Pulling the levers with gentle steady pressure, the plunger (piston) of the lower syringe compresses the product in the syringe until the contents of the lower syringe are expelled through the Luer to Luer coupler into the upper syringe. The levers are returned to the upright position thereby lowering the piston shoe to enable the rotatable support arm to be rotated for the next cycle.

The support arm is rotated 180 degrees to place the loaded syringe (the loaded syringe is the syringe that contains product) on the bottom. The levers are pulled forward until the piston shoe makes contact with the thumb grip of the plunger of the lower syringe. The above process is then repeated a sufficient number of times until the operator is satisfied that adequate mixing has occurred. The PLO in the syringe is now morphine 5 mg/1 ml. There has been no need to weigh morphine or measure or mix raw ingredients. The entire process is quick and clean. There is no chance for contamination because the transfers and mixing were all done in a closed environment. The morphine 5 mg/1 ml PLO can now be loaded directly into appropriate oral syringes for dispensing and labeled for topical use.

Transfer Product from Syringe to Push-Up-Bottom Jar

To transfer the contents of a 140 ml syringe to a push-up-bottom jar, attach the unique Luer to jar connector to the tip of the 140 ml syringe. Insert the flanges of the 140 ml syringe into the bottom support of the vertically positioned rotatable support arm with the connector end of the syringe pointing upward. The nozzle of a push-up-bottom jar is then screwed into the connector. The jar is now upside down and joined by the connector to the 140 ml syringe. The levers of the machine are pulled slowly toward the operator until the shoe of the machine's piston just makes contact with the thumb pad of the syringe plunger. The number of milliliters or product in the 140 ml syringe is noted to make a record of what volume of product has been transferred to the jar. The operator continues pulling the levers toward the operator to expel product from the syringe, through the connector and into the jar until the desired volume of product has been transferred. The next step is to unscrew the jar, cap it and label as to contents and expiration if required. To transfer product from push-up-bottom storage jars to syringes, the process is reversed. The connector is the same, but the jar is on the bottom and the syringe is pointing downward into the connector.

Using the Grinder Attachment

The operator removes the rotatable support arm from the stanchion and attaches the grinder assembly to the stanchion. The next step is to remove the syringe/jar shoe from the machine's piston and install the mortar cup on the machine's piston. The mortar liner cup can be used to weigh drug granules on a balance. The liner cup and its contents are placed into the mortar. A pestle cover is clipped onto the pestle.

With a gentle pressure the levers of the machine are pulled toward the operator until the mortar contents rise to come in contact with the pestle. The levers are gently pulled toward the operator until the pestle is fully retracted. By slowly pushing the levers away from the operator to lower the machine's piston, and with it the mortar, the product in the mortar is removed from contact with the pestle. The grinding process is continued until the product is as fine as necessary. The cup is removed from the mortar and product is transferred for its intended use.

What is claimed is:

1. A device for substantially uniformly distributing an active ingredient within a transdermal vehicle, said transdermal vehicle being a viscous material and said active ingredient being in particulate form, comprising:

a-first container, b-said first container containing a non-uniform mixture of a transdermal vehicle and said active ingredient, said first container having a restricted opening at its proximal end and a first container piston mounted movably within said first container for movement between a first position proximate said first container distal end to a second position proximate said proximal end of said first container, c-second container, said second container having a distal end and a restricted opening at its proximal end and a second container piston mounted movably within said second container for movement from a first position proximate said distal end of said second container to a position proximate said proximal end of second container, said second container being threadedly secured to said first container at said proximal end, said first container restricted opening and said second container restricted opening being in open communication, said first container piston being movable from said position proximate said distal end to a position proximate said proximal end, said movement causing said mixture to be forced from said first container through said first container restricted opening and said second container restricted opening, into said second container, d-support member, said support member having a horizontal base and a vertical element fixed to said horizontal base, said first container and said second container being releasably and rotatably mounted on said vertical element of said support member, parallel to said vertical element, e-drive means, said drive means being mounted on said horizontal base of said support member, and having a drive means piston, said drive means piston being vertically movable relative to said horizontal base and being positioned to contact said first container piston when said first container piston is in a first location proximate said drive means, and being positioned to contact said second container piston when the position of said first container and said second container are rotated relative to said support member horizontal base and said second container piston is in said first location and said first container piston is in a second location, f-a lever member, said lever member being mounted to activate said drive means piston to selectively move said first container piston from said position proximate said distal end to a position proximate said proximal end or said second container piston from said position proximate said second container distal end to a position proximate said second container proximal end.

2. The device of claim 1, wherein said lever member is mounted for movement in a plane parallel to the plane of said support member vertical element, and perpendicular to the plane of said support member horizontal base, for manual application of a mechanically multiplied force to the piston.

3. The device of claim 2, wherein said lever member is mounted for rotational movement between a position near a horizontal orientation to a position near a vertical orientation, thereby activating said drive means piston to move vertically relative to said horizontal base.

4. The device of claim 3, wherein said proximal end of said first container is threadedly connected to said proximal end of said second container by an internally threaded Luer.

5. The device of claim 1, wherein said first container is a first syringe, said first syringe having an extension member at said distal end, and further comprising a support arm member secured to said support member vertical element, said support arm member being adjustably secured to said support member for upward and downward movement relative to said vertical element, and having a groove for slidably receiving said extension member, whereby said first syringe extension member slid ably engages said support arm and thereby is removably secured said to said support arm member.

6. The device of claim 5, wherein said second container is a second syringe, said second syringe having an extension member at said distal end, whereby said second syringe extension member is slid ably engagable with said support arm.

7. A device for use in transferring a transdermal vehicle having an active ingredient substantial uniformly distributed therein, comprising:

a- first container said first container containing a substantially uniform mixture of a transdermal vehicle and said active ingredient, said first container having a restricted opening at its proximal end and a seal member mounted movably within said first container for movement between a first position proximate a distal end of said first container to a second position proximate said proximal end of said first container, and said first container being a supply container, b a second container, said second container having a restricted opening at its proximal end in open communication with said first container, said second container being threadedly secured to said first container and having an interior volume less than that of said first container, c support member, said support member comprising a vertical element and an arm member oriented horizontally relative to said vertical element, said first container and said dose container being releasably secured to said arm member and being oriented parallel to said vertical element, d drive means, said drive means being mounted in a fixed position relative to said support member, said drive means having a drive means piston vertically movable relative to said vertical element and positioned to contact said first container seal member when said first container seal member is in said first position proximate said drive means said first container seal member being movable by said drive means piston from said first position proximate said distal end to said second position proximate said proximal end, said movement causing said mixture to be forced from said first container through said first container restricted opening and said container restricted opening, into said dose container, e lever member, said lever member being mounted to activate said drive means piston to selectively move said first container seal member from said first position proximate said distal end to said second position proximate said proximal end, and being mounted for movement in a plane parallel to the plane of said support member vertical element for manual application of a mechanically multiplied force to the piston, said movement being a rotational movement between a position near the horizontal orientation to a position near a vertical orientation, said rotational movement activating said drive means piston to move vertically relative to said vertical element.

8. The device of claim 7, further comprising a Luer connector, said supply container being threadedly connected to a first end of said Luer connector and said dose container being threadedly connected to a second end of said Luer connector.

9. The device of claim 8, wherein said Luer connector second end is internally threaded to receive external threads of said dose container.

10. The device of claim 7, wherein said first container interior volume is sufficient to contain multiple doses of said transdermal vehicle and said dose container interior volume is sufficient to contain a single dose of said transdermal vehicle, at least one of said dose container and lever member being provided with gradations used to identify a quantity of transdermal vehicle, said lever being incrementally movably to a degree that corresponds to a single dose of medication.

11. The device of claim 7, wherein the lever's movement during filling of said dose container is restricted to a single direction until such time as said supply container is emptied and wherein incremental movement of said lever corresponds to a predetermined volume of medication.

12. The device of claim 7, further comprising said dose container being a tube having sealable open distal end.

13. A device for substantially uniformly distributing an active ingredient within a transdermal vehicle, said transdermal vehicle being a viscous material and said active ingredient being in particulate form, comprising:

a first container said first container containing a non-uniform mixture of a transdermal vehicle and said active ingredient, said first container having a first container restricted opening at its proximal end and a first container piston mounted movably within said first container for movement between a first position proximate said first container distal end to a second position proximate said first container proximal end, b support member, said first container being mounted on said support member, c second container, said second container being secured to said first container, said second container having a second container restricted opening at its proximal end and a second container piston mounted movably within said second container for movement from a first position proximate said second container distal end to a second position proximate said proximal end of said second container d, said first container restricted opening and said second container restricted opening being in open communication, said first container piston movement from said first position proximate said distal end to said second position proximate said proximal end forces said mixture from said first container through said first container restricted opening and said second container restricted opening, into said second container, and said second container piston movement from said first position proximate said distal end to said second position proximate said proximal end forces said mixture from said second container through said second container restricted opening and said first container restricted opening, into said first container, d drive means, said drive means being mounted in a fixed position relative to said support member, said drive means having a drive means piston positioned to contact said first container piston when said first container piston is in a first location proximate said drive means, and being positioned to contact said second container piston when the position of said first container and said second container are rotated relative to said support member, and wherein when said second container piston is in said first location said first container piston is in a second location, e means to activate said drive means piston to selectively move said first container piston from said first position proximate said distal end to said second position proximate said proximal end or said second container piston from said first position proximate said distal end of said second container to said second position proximate said proximal end of said second container, said means to activate said drive means piston being a lever and gear mechanism, and f an arm member, said first container and said second container being secured said to said arm member and said first container and said second container being rotatable relative to said support member, said arm member being secured to said support member, and whereby the positions of said first container and second container relative to said support member, are rotatable substantially 180 degrees such that said first container piston is in direct contact with said drive means piston when said first container and said second container are in a first rotated position and said second container piston is in direct contact with said drive means piston when said first container and said second container are in a second rotated position.

* * * * *